US006526725B1

(12) United States Patent
Williams

(10) Patent No.: US 6,526,725 B1
(45) Date of Patent: Mar. 4, 2003

(54) APPARATUS AND METHOD FOR ATTACHING STRAWS TO CONTAINERS

(75) Inventor: Edward F. Williams, Derry, NH (US)

(73) Assignee: Shrink Packaging Systems Corporation, Nashua, NH (US)

( * ) Notice: Subject to any disclaimer, the term of this patent is extended or adjusted under 35 U.S.C. 154(b) by 0 days.

(21) Appl. No.: 09/590,357

(22) Filed: Jun. 8, 2000

Related U.S. Application Data

(60) Provisional application No. 60/140,551, filed on Jun. 23, 1999.

(51) Int. Cl.[7] ..... B65B 61/00

(52) U.S. Cl. ..... 53/410; 53/133.1; 53/133.2; 493/87; 493/379; 83/331; 83/663

(58) Field of Search ..... 53/133.1, 133.2, 53/410; 83/331, 343, 344, 663; 493/87

(56) References Cited

U.S. PATENT DOCUMENTS

| | | | | | |
|---|---|---|---|---|---|
| 1,777,791 | A | * | 10/1930 | Fritz et al. | 83/344 |
| 3,731,575 | A | * | 5/1973 | Gelin | 65/536 |
| 4,210,484 | A | | 7/1980 | Crankshaw et al. | 156/542 |
| 4,233,331 | A | | 11/1980 | Lemke et al. | 426/407 |
| 4,293,369 | A | | 10/1981 | Dilot et al. | 156/521 |
| 4,309,237 | A | | 1/1982 | Lemke et al. | 156/521 |
| 4,384,915 | A | | 5/1983 | Utsumi | 156/499 |
| 4,572,758 | A | | 2/1986 | Wild | 156/256 |
| 4,584,046 | A | | 4/1986 | Geyssel | 156/358 |
| 4,584,819 | A | | 4/1986 | Hakansson | 53/410 |
| 4,589,947 | A | | 5/1986 | Tsuda | 156/521 |
| 4,669,699 | A | * | 6/1987 | Kaneko | 248/652 |
| 4,707,965 | A | | 11/1987 | Becker | 53/410 |
| 4,903,458 | A | | 2/1990 | Hakansson | 53/410 |
| 5,037,366 | A | * | 8/1991 | Yokoyama | 493/84 |
| 5,313,863 | A | * | 5/1994 | Aihara et al. | 83/171 |
| 5,344,519 | A | | 9/1994 | Galchefski et al. | 156/456 |
| 5,375,391 | A | | 12/1994 | Persson et al. | 53/133.1 |
| 5,979,142 | A | * | 11/1999 | Kraft et al. | 53/133.1 |
| 6,045,616 | A | * | 4/2000 | Williamson et al. | 118/301 |
| 6,282,865 | B1 | * | 9/2001 | Bergstrom et al. | 53/128.1 |

* cited by examiner

*Primary Examiner*—Rinaldi I. Rada
*Assistant Examiner*—Thanh Truong
(74) *Attorney, Agent, or Firm*—Pearson & Pearson, LLP

(57) ABSTRACT

A straw application machine for automatically applying drinking straws, wrapped in protective cover, to beverage containers at very high speeds. The machine comprises a guide roller which presses each straw of a web of parallel straws into a slotted straw drum. A blade cutting drum separates the straws as it rotates in close association and synchronization with the slotted straw drum. A strip of sticky tape runs along the back of the web of parallel straws and a protective cover is removed from the tape exposing an adhesive prior to passing underneath the right side of the guide roller. After the straws are cut from the web, an ejector bar applies each straw to a beverage package where it is retained by the adhesive tape or glue. Multiple servo motors control the operating speed of the machine. Alternate embodiments for the slotted straw drum include a drum center having rubber ends with slots for holding a larger straw, and a drum center having end plates with inserts for holding straws.

46 Claims, 19 Drawing Sheets

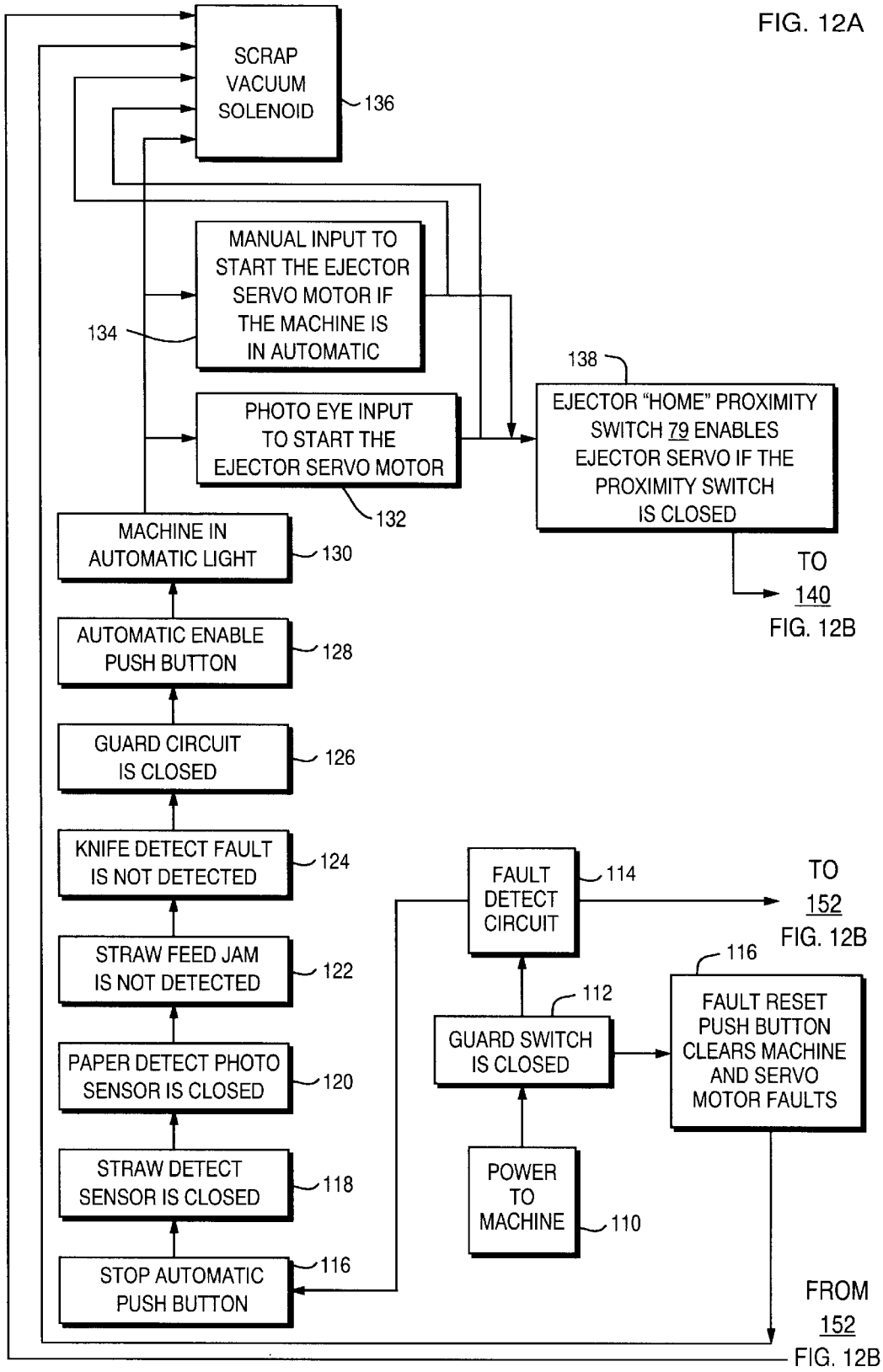
FIG. 12A
SCRAP VACUUM SOLENOID
136
MANUAL INPUT TO START THE EJECTOR SERVO MOTOR IF THE MACHINE IS IN AUTOMATIC
134
138
EJECTOR "HOME" PROXIMITY SWITCH 79 ENABLES EJECTOR SERVO IF THE PROXIMITY SWITCH IS CLOSED
PHOTO EYE INPUT TO START THE EJECTOR SERVO MOTOR
132
TO 140
FIG. 12B
MACHINE IN AUTOMATIC LIGHT
130
AUTOMATIC ENABLE PUSH BUTTON
128
GUARD CIRCUIT IS CLOSED
126
KNIFE DETECT FAULT IS NOT DETECTED
124
FAULT DETECT CIRCUIT
114
TO 152
FIG. 12B
STRAW FEED JAM IS NOT DETECTED
122
116
112
GUARD SWITCH IS CLOSED
FAULT RESET PUSH BUTTON CLEARS MACHINE AND SERVO MOTOR FAULTS
PAPER DETECT PHOTO SENSOR IS CLOSED
120
STRAW DETECT SENSOR IS CLOSED
118
POWER TO MACHINE
110
STOP AUTOMATIC PUSH BUTTON
116
FROM 152
FIG. 12B

APPARATUS AND METHOD FOR ATTACHING STRAWS TO CONTAINERS

This is a regular patent application claiming priority of provisional application for patent Ser. No. 60/140,551, filed Jun. 23, 1999.

BACKGROUND OF THE INVENTION

1. Field of the Invention

The present invention relates generally to a method and apparatus for attaching straws wrapped in protective covering to containers and more particularly to a high speed machine having a slotted roller for receiving a web of parallel straws and a cutting roller for separating the straws as it rotates in close association with the slotted roller.

2. Description of Related Art

The attachment of drinking straws wrapped in a protective covering to a beverage container has been performed many ways in the prior art. Generally the wrapped straws are arranged in parallel with respect to each other and each straw is positioned perpendicular to the length of the roll forming a web. It is known to provide an adhesive surface along the length of the web. It is also known to apply a hotmelt adhesive on the side of a container or package. It is further known to provide a knife or blade to separate the straw from the web in order to be able to attach it to the container. However, the speed at which straws can be attached to containers has been in the range of 300–350 straws per minute. In U.S. Pat. No. 4,233,331, issued Nov. 11, 1980 to Harold C. Lemke, et al., a method of securing a can opening key to a container end is described using oriented polypropylene film with solventless acrylic adhesive. The method comprises providing a container end feeder and providing a key feeder which cooperates with a vacuum applicator and tape cutoff system to position tapes and keys for assembly and bonding to the container ends. The method includes interfacing a cutoff blade wheel to a vacuum wheel to form the vacuum applicator and tape cutoff system. The blade wheel carries tool steel blades. The vacuum wheel rotates clockwise and cutoff blade wheel rotates counter-clockwise. The method includes the step of a feeder system supplying tape to a mandrill having an anvil surface. The cutoff blade meets the anvil severing a preset strip of tape.

In U.S. Pat. No. 4,584,819, issued Apr. 29, 1986, to Jan Hakansson, an apparatus for feeding a series or band of straws off a strip onto a series of packages with adhesive is described. The straws are supplied to a rotary drum where they are severed from the band by a reciprocating knife. An adhesive applicator applies adhesive (hotmelt) on the side of the package for holding the straws on the package. However, the use of a hotmelt adhesive is a slower process whereby a slower reciprocating knife is suitable for the apparatus.

In U.S. Pat. No. 4,572,758, issued Feb. 25, 1986, to Rudolf Wild, a machine and method for attaching drinking straws in protective coverings to beverage containers is described. Efficiency is achieved by batch processing wherein a number of straws are separated from a tape at one time at a cutting station, several separating knives are fastened to a knife disk. The knives vertically move into slots. Placing a leading batch of straw packages of tape in the cutting machine results in five straw packages being separated resulting in parallel processing of the five straw packages and beverage containers. Adhesive strip has a covering tape peeled away for attaching the straw to the container. However, reciprocating knives in such a straw application machine have been known to heat up resulting in the adhesive or glue attaching to the knives which results in the machine jamming.

In U.S. Pat. No. 4,707,965, issued Nov. 24, 1987, to Gert Becker, a method and apparatus for attaching drinking straws to packaging containers from a straw roller is described. A first conveyor transports containers, a second conveyor transports drinking straws, the containers and drinking straws enter into a fastening device for attaching individual straws to individual containers at a controlled moment, defining the moment by determining the position and the transporting speed of the individual containers before entering the fastening device, and determining the relative position of the individual containers in relation to the first conveyor. A knife holder comprises a knife shaft on which are fixed two knife holders which carry at their ends the actual severing knives. When the shaft rotates the connecting webs of the straw belt are severed enabling the drinking straws to be extracted individually from the straw roller. A hotmelt glue unit having a hotmelt glue application head applies glue to the container for holding the straws. However, hotmelt glue requires a drying time which limits the speed of the apparatus for attaching drinking straws to packaging containers.

In U.S. Pat. No. 4,903,458, issued Feb. 27, 1990, to Jan Hakansson, an apparatus for attaching bendable elongated drinking straws to a side of a container is described. After attaching the straw a device folds the drinking straw beyond the edge of the container. The straws are accumulated around a drum in spaces arranged at a uniform pitch around the drum. The straws are supplied to the drum in a band. The straws are separated from each other by a knife which is controlled by an air cylinder, and the knife penetrates spaces around the drum on each side of the straw. An applicator applies a bonding agent (hotmelt) to the container for holding the straw. However, this cutting system is inherently slower because of the drying time of the hotmelt thereby permitting the use of a slower knife controlled by an air cylinder.

In U.S. Pat. No. 5,344,519, issued Sep. 6, 1994, to John M. Galchefski et al., an apparatus for applying labels onto small cylindrical articles including a label transport drum constructed for aiding the transfer is described. Vacuum drawn through parts on the drum and through orifices on label retaining plates, retains the label to the drum surface. FIG. 1A shows an off-drum cutting assembly. The knife assembly includes a cutting wheel having opposing cutting blades that engage the strip, cutting the strip into labels. The cut label is transferred to the surface of the label transport drum. The label then moves with the drum into an article wrapping position.

In U.S. Pat. No. 5,375,391, issued Dec. 27, 1994, to Goran Persson et al., a system for feeding straws on a package by means of a feed wheel is described which receives a series of parallel straws from a strip holder for feeding onto a package. Adjacent to the feed wheel is a knife (not shown) for separating the various straws from the connected straws. The knife is controlled by some form of pneumatically controlled piston and cylinder wire.

SUMMARY OF THE INVENTION

Accordingly, it is therefore an object of this invention to apply protectively covered drinking straws to containers at high speeds.

It is another object of this invention to provide a blade cutting drum for separating a web of parallel straws positioned on a slotted drum as the blade cutting drum rotates in close association with the slotted drum.

It is a further object of this invention to provide an ejector bar to apply the covered straw separated from a straw web to a container.

It is yet another object of this invention to accommodate a web of straws comprising a preattached adhesive tape or a web straws whereby glue is applied to the straws after the web is positioned on the slotted drum.

It is another object of this invention to provide sensors to detect a plurality of functions and to shut down the apparatus if a malfunction is sensed.

It is a further object of this invention to provide first alternate embodiment of a straw drum comprising rubber ends having slots for holding larger straws.

It is yet another object of the invention to provide a second alternate embodiment of a straw drum having end plates with inserts inserted into slots of the end plates.

The objects are further accomplished by providing an apparatus for separating straws from a web at a high rate of speed and attaching each of the straws to one of a plurality of containers, the improvement comprising means, rotating in a first direction and having a plurality of slots, for receiving the web of straws, means, rotating in a second opposite direction and having a plurality of blades, for cutting each of the straws from the web, and means for controlling the receiving means and the cutting means, the receiving means disposed adjacent to the cutting means wherein each of the plurality of blades serially enters a slot on the receiving means to accomplish the cutting. The apparatus comprises a straw guide assembly for guiding the web of straws into the apparatus. The receiving means comprises a first plurality of slots extending a first predetermined depth into the receiving means, and a second plurality of slots extending a second predetermined depth into the receiving means, the first plurality of slots alternating with the second plurality of slots around the circumference of the receiving means. The plurality of blades are equally spaced a predetermined distance from each other around the circumference of the cutting means. The plurality of blades extend a predetermined distance above the circumference of the cutting means. The apparatus comprises means for pressing each straw of the web into one of the plurality of the slots. The plurality of blades of the cutting means extend into the plurality of slots of the receiving means on each side of straw holding slots as the receiving means and the blades of the cutting means rotate in opposite directions. The apparatus comprises a first servo motor coupled to an ejector bar for controlling the speed of applying each of the straws to the plurality of containers. The controlling means comprises a second servo motor for controlling the rotation of the receiving means and the cutting means. The apparatus comprises means positioned above the receiving means, for removing a protective cover of an adhesive tape on the web of straws. The apparatus may also include means positioned adjacent to the receiving means for applying an adhesive to the web of straws. The receiving means comprises a drum made of aluminum. The drum may also comprise an inner aluminum portion and an outer flexible material portion.

A first alternate embodiment of the straw drum comprises a cylindrical, metallic center portion having at least one groove around its circumference for receiving an ejecting arm, a first flexible material, circular end means, positioned on a first end of the center cylindrical metallic portion, for holding a first portion of a straw, a second flexible material, circular end means, positioned on a second end of the center cylindrical metallic portion, for holding a second portion of the straw, and each of the first and second flexible material, circular end means comprises the first plurality of slots extending a first predetermined depth into the straw drum and the second plurality of slots extending a second predetermined depth into the straw drum.

A second alternate embodiment of the straw drum comprises at least one groove around the central circumference of the drum for receiving an ejecting arm, a first end portion of the drum comprises a group of the plurality of slots positioned around the circumference of the first end portion, each of the first group of the plurality of slots around the first end portion of the drum comprises insert means for grasping a straw, a second end portion of the drum comprises a second group of the plurality of slots positioned around the circumference of the second end portion, and each of the second group of the plurality of slots around the second end portion of the drum comprises insert means for grasping the straw. The insert means comprises a spaced apart first leg and second leg extending from a base providing flexible upper ends for grasping the straw.

The objects are further accomplished by providing an apparatus for separating straws from a web of straws and attaching each separated straw to a container of a plurality of containers at a high rate of speed comprising means for receiving the web of straws, the receiving means rotating in a first direction and having a plurality of straw slots, means for pressing each straw of the web into one of the plurality of straw slots, means, disposed adjacent to the receiving means and rotating in an opposite second direction, for separating each straw serially from the web at the high rate of speed, means coupled to the receiving means and the separating means for controlling the rotation of the receiving means and the separating means, and means extending within a portion of the receiving means for ejecting each of the separated straws to contact one of the plurality of the containers. The apparatus comprises a straw guide assembly for guiding the web of straws into the apparatus. The web receiving means comprises a cylindrical straw drum having a first plurality of slots extending a first predetermined depth into the straw drum, and a second plurality of slots extending a second predetermined depth into the straw drum, the first plurality of slots alternating with the second plurality slots around the circumference of the straw drum. The separating means comprises a cylindrical drum having a plurality of blades spaced a predetermined distance from each other around the circumference of the drum. The plurality of blades extend a predetermined distance above the perimeter of the blade cylindrical drum. The separating means comprises a plurality of blades extending into the plurality of straw slots of the receiving means on each side of the straw slots as the receiving means and the blades of the separating means rotate in the opposite directions. The ejecting means comprises a first servo motor coupled to an ejector bar for controlling the speed of applying each of the straws to the container. The controlling means comprises a second servo motor for controlling the rotation of the receiving means and the separating means. The apparatus comprises means positioned above the pressing means, for removing a protective cover of an adhesive tape on the web of straws. The apparatus may also comprise means positioned adjacent to the receiving means for applying an adhesive to the web of straws. The straw drum comprises aluminum, and it may comprise an inner aluminum portion and an outer flexible material portion.

A first alternate embodiment of the straw drum comprises a cylindrical, metallic center portion having at least one groove around the circumference of the straw drum for receiving the ejecting means, a first flexible material, circular end means, positioned on a first end of the cylindrical metallic center portion, for holding a first portion of a straw, a second flexible material circular end means, positioned on a second end of the cylindrical metallic center portion, for holding a second portion of the straw, and each of the first and second flexible material, circular end means comprises the first plurality of slots extending a first predetermined depth into the straw drum and the second plurality of slots extending a second predetermined depth into the straw drum.

A second alternate embodiment of the straw drum comprises at least one groove around the central circumference of the straw drum for receiving the ejecting means, a first end portion of the straw drum comprises a plurality of slots positioned around the circumference of the first end portion, each of the plurality of slots around the first end portion of the straw drum comprises insert means for grasping a straw, a second end portion of the straw drum comprises a plurality of slots positioned around the circumference of the second end portion, and each of the plurality of slots around the second end portion of the straw drum comprises insert means for grasping the straw. The insert means comprises a spaced apart first leg and second leg extending from a base providing flexible upper ends for grasping the straw.

The objects are further accomplished by a method for separating straws from a web of straws and attaching each separated straw to a container of a plurality of containers at a high rate of speed comprising the steps of receiving the web of straws by means having a plurality of straw slots for holding the straws, the receiving means rotating in a first direction, pressing each straw of the web into one of the plurality of straw slots, separating each straw serially from the web at the high rate of speed with means disposed adjacent to the receiving means, controlling the rotation of the receiving means and the separating means with servo drive means, ejecting each of the separated straws to contact one of the plurality of containers with means extending within portion of the receiving means. The method comprises the step of guiding the web of straws into the receiving means with a straw guide assembly. The step of receiving the web of straws comprises the step of providing a straw drum having a first plurality of the straw slots extending a first predetermined depth and a second plurality of slots having a second predetermined depth into the straw drum, the first plurality of slots alternating with the second plurality of slots around the circumference of the straw drum. The step of separating each straw serially from the web comprises the step of providing a cylindrical drum having a plurality of blades spaced a predetermined distance from each other around the circumference of the cylindrical drum. The step of providing a plurality of blades around the circumference of the cylindrical drum comprises the step of extending the blades a predetermined distance above the surface of the blade cylindrical drum. The step of separating each straw serially from the web comprises the steps of rotating in a first direction the receiving means comprising a straw drum having the plurality of straw slots with straws of the web pressed therein, and rotating in an opposite second direction the separating means comprising a blade drum having the plurality of blades extending therefrom in close association with the straw drum. The step of rotating the straw drum in the first direction and the blade drum in the second direction comprises the step of providing a plurality of blade slots in the straw drum on each side of the straw slots for receiving the plurality of blades extending from the blade drum. The step of ejecting each of the separate straws comprises the step of coupling a first servo motor to an ejector bar for controlling the speed of ejecting and applying each of the separated straws to one of the plurality of containers. The step of controlling the rotation of the receiving means and the separating means with servo drive means comprises the step of providing pre-programmed second servo motors for controlling the speed of the apparatus. The method comprises the step of removing a protective cover of an adhesive tape on the web of straws with means positioned above the receiving means.

Additional objects, features and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

FIGS. 12A and 12B show an electrical flow chart for the sensors and control functions to permit proper operation of the straw applicator apparatus of FIG. 1 and FIG. 3;

DETAILED DESCRIPTION OF ILLUSTRATIVE EMBODIMENTS

Figure 1:
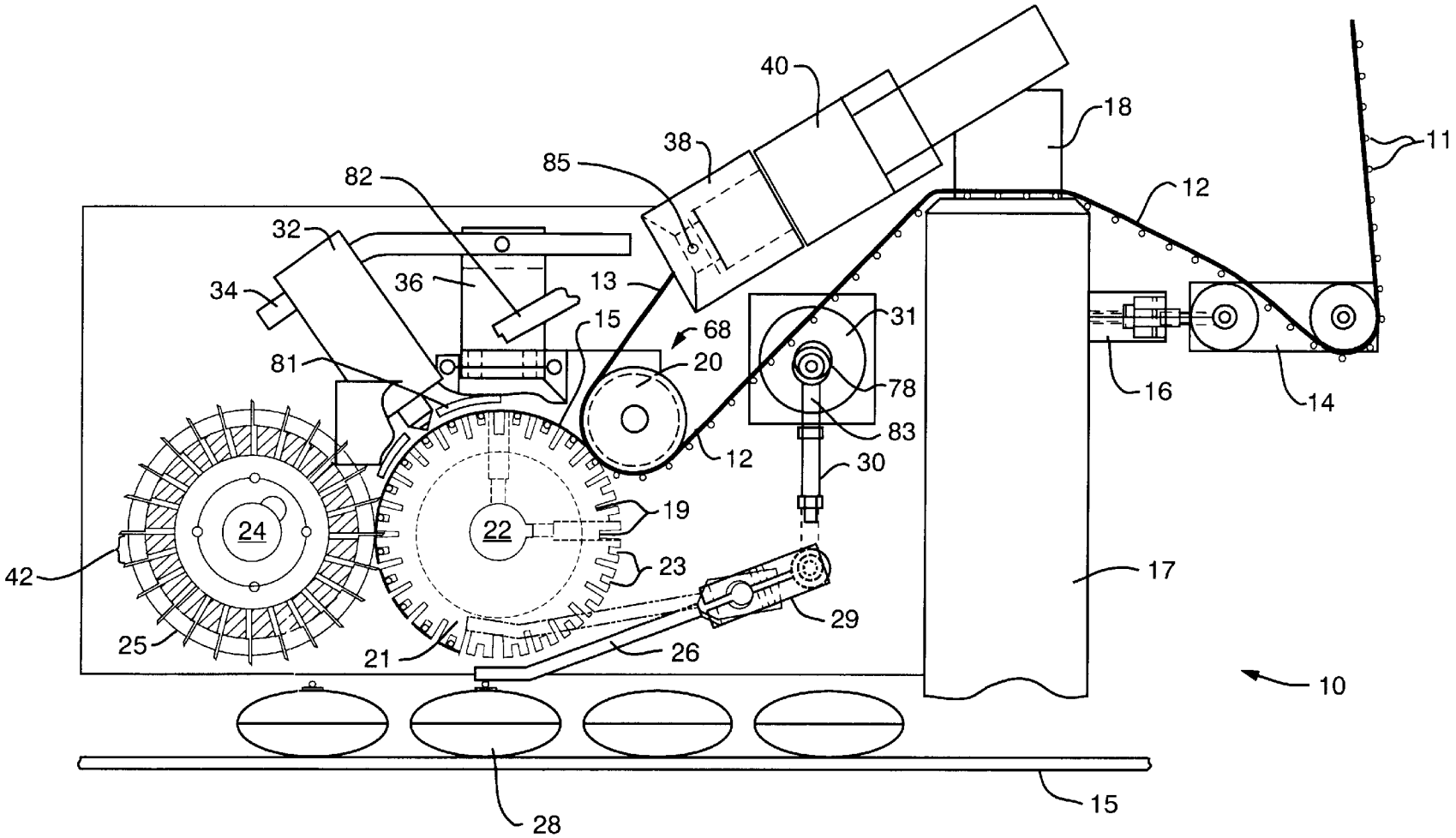
FIG. 1 is a front elevational view of the straw application for high speed attaching of straws to containers.

Referring to FIG. 1, a front elevational view of a straw application apparatus 10 for high speed attachment of straws to containers 28 is shown. The apparatus 10 comprises means for feeding a web 12 of straws 11 into the apparatus 10 including a pivoting straw guide assembly 14 attached to a pivot bearing assembly 16 extending from the side of a support column 17 and a straw guide assembly 18 positioned on top of the support column 17. The apparatus receives straws 11 from reels of straws or from a jumbo box method wherein straws 11 fan back and forth inside a large box (not shown). Both methods allow the apparatus to run for large periods of time. The Web 12 travels, for example, from the large box through the pivoting straw guide assembly 14 which changes position as the straws in a jumbo box empty from various angles. The Web 12 of straws 11 travel to a straw drum 21 through the straw guide assembly 18 which ensures that the straws remain centered to the straw drum 21. A compression guide roller 20, disposed adjacent to and partially above a slotted roller assembly 22, presses the web 12 of straws into the straw drum 21 of the slotted roller assembly 22, each straw 11 being pressed into one of a plurality of straw slots or grooves 23 around the circumference of the straw drum 21. The guide roller 20 is part of a compression roller assembly 68 that pivots on a hinge for easy access to the straw drum 21 to facilitate straw threading or straw jam removal. A fiber optic sensor 89 (FIG. 5) detects the presence of the straw web 12. If the web 12 is not present, the apparatus either shuts down or does not start up. The slotted roller assembly 22 also comprises a shaft 46, key (not shown), and two flange bearings 56.

"Referring to FIG. 1, the web 12 of straws 11 passes partially around the compression guide roller 20, and backing paper 13 on the adhesive is removed. The backing paper 13 passes into a paper guide 38 and then into a venturi assembly 40 for disposal."

Figure 2:
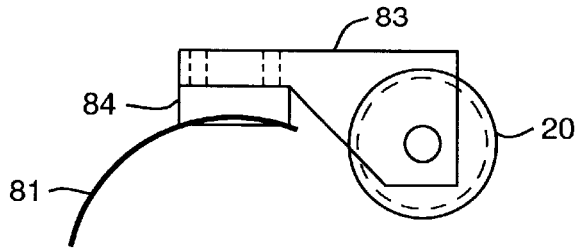
FIG. 2 is a side elevational view of the compression roller assembly.
Figure 3:
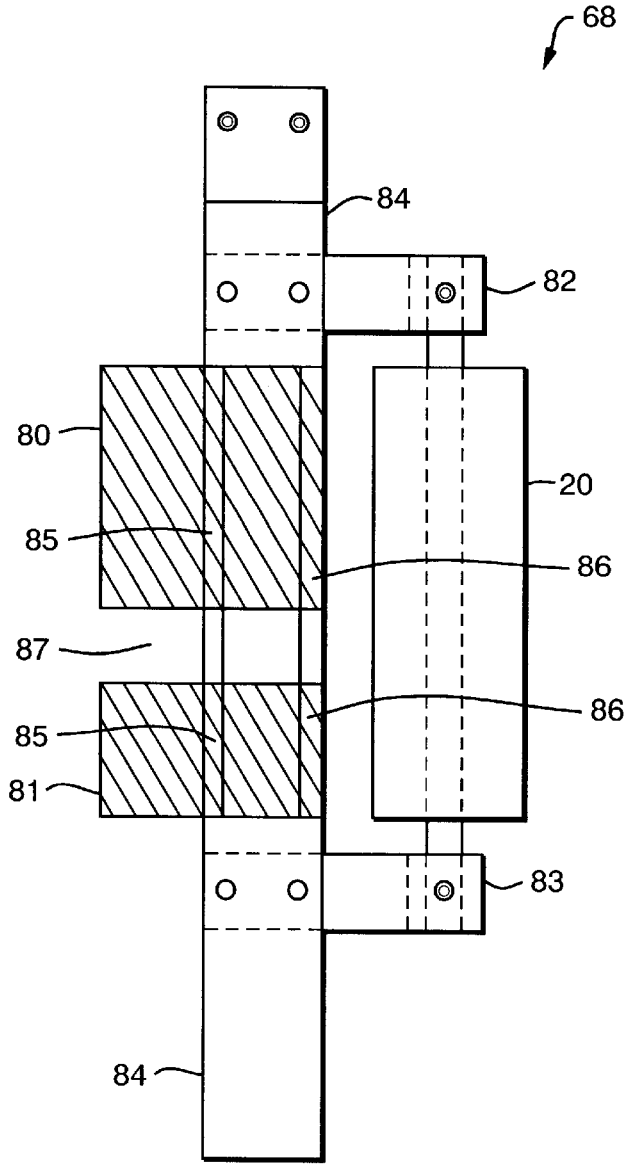
FIG. 3 is a top view of the compression roller assembly.

"Referring to FIG. 2 and FIG. 3, FIG. 2 shows a side elevational view of the compression roller assembly 68 and FIG. 3 shows a top view. As noted above, the compression roller assembly 68 comprises the guide roller 20 held in place between the end brackets 82, 83. The end brackets 82, 83 are attached by screws to a stainless steel bar 84 which has drum guides 80, 81 welded to its underside along surfaces 85 and 86. The drum guide follows the curvature of the straw drum 21 extending a radial distance of approximately 90 degrees. Space 87 is provided between the two drum guides 80, 81 for a glue dispensing gun 32. If the apparatus is using hot melt adhesive, a dot of glue is applied to each straw 11 after the compression roller assembly 68 and just before the straw web 12 gets cut by the serrated blades of a blade drum 25."

Figure 13:
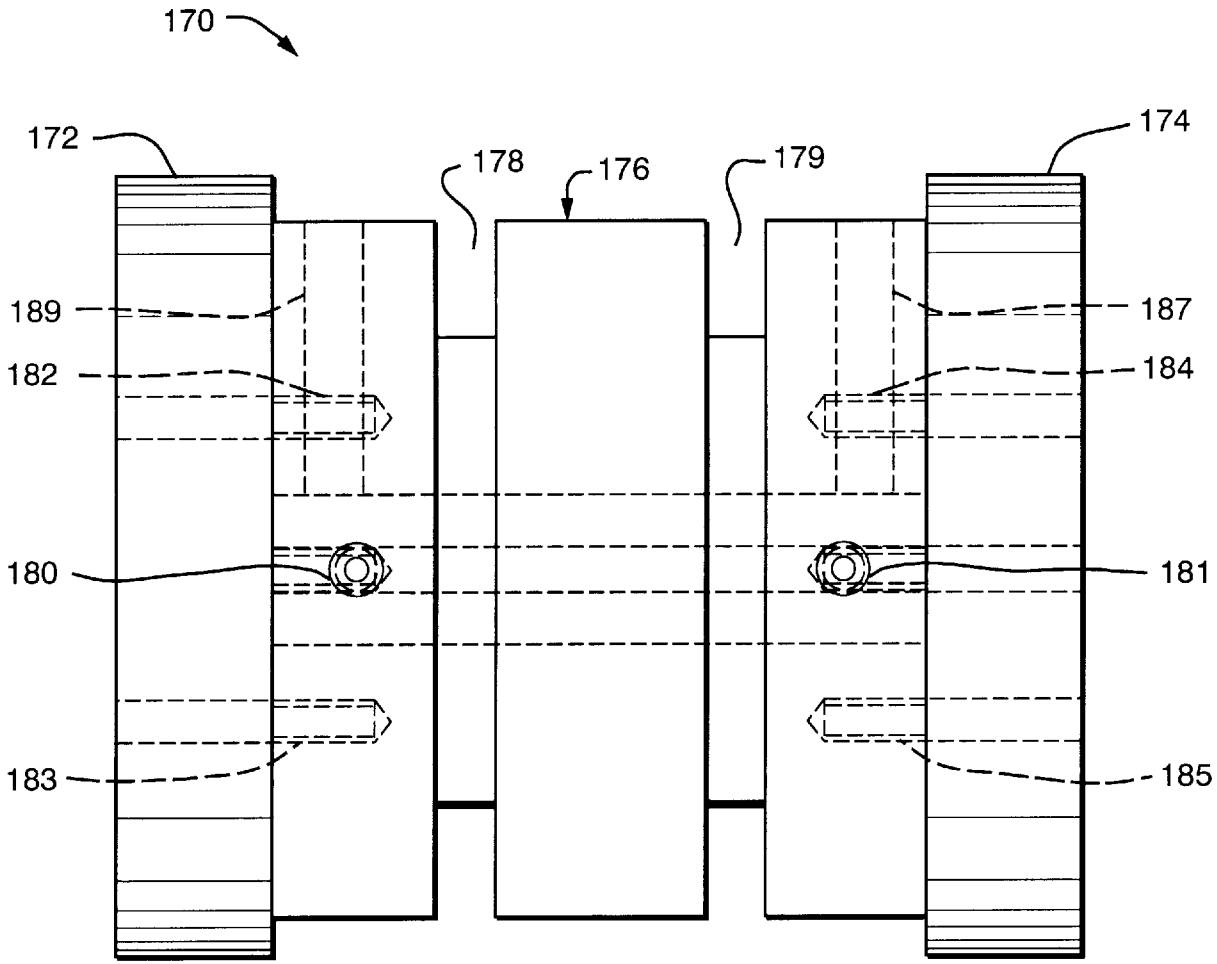
FIG. 13 is a front elevational view of the first alternate embodiment of the straw drum having molded rubber ends.
Figure 17:
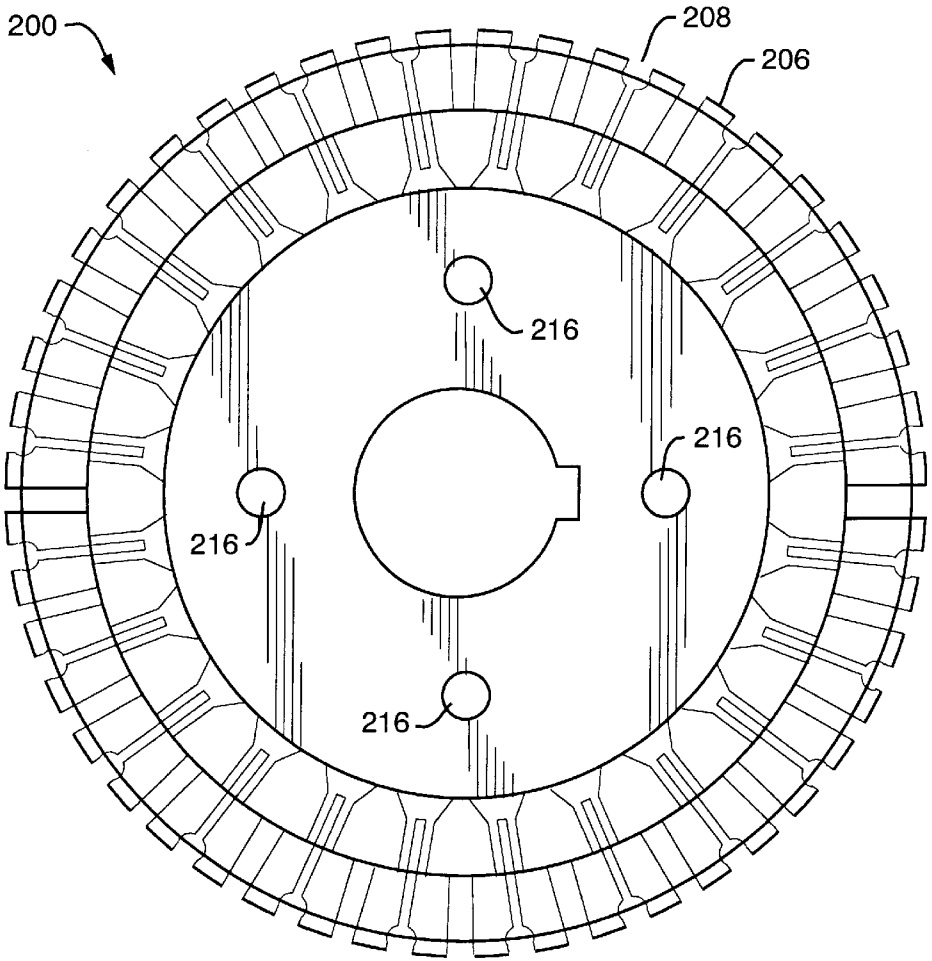
FIG. 17 is a side elevational view of a second alternate embodiment of a straw drum having the center portion of FIG. 15 with an insert end plate attached on each end of the center portion.

Referring again to FIG. 1, the straw drum 21 is made of aluminum in the preferred embodiment. However, for larger size straws one skilled in the art will recognize that a drum 21 made totally or partially of a flexible material such as a silicon rubber or urethane rubber may be desirable to handle the varying shape of such larger straws. Such alternate embodiments are shown in FIG. 13 and FIG. 17 and described hereinafter.

"A blade cutting roller assembly 24 comprises the blade drum 25 which is positioned adjacent to the straw drum 21 in the same horizontal plane. The straw drum 21 rotates in a counter-clockwise direction whereas the blade drum 25 rotates in a clockwise direction. A plurality of blades 42 extending from the blade drum 25 are inserted into an equal plurality of slots around the circumference of the straw drum 21. The blades 42 extend approximately 0.190 inches above the surface of the drum 25 in the preferred embodiment. As the blade drum 25 and the straw drum 21 rotate in close association and synchronously, the blades cut the web 12 that holds the straws in close association at a point centered between each straw 11. The blade cutting roller assembly 24 also comprises a drive shaft 47, key (not shown) and two flange bearings 48.

Ejector bars 26 extend from a shaft 27 which connects to an ejector lever 29, and the ejector lever 29 connects to the rod end bearing stud 30. A proximity switch 79 detects that an ejector cam 78 is at a "home" position for the start of the next revolution of the ejector servo motor 31. At a position of 180 degrees of the ejector servo motor 31 cycle, a straw 11 ejects from the straw drum 21 by means of the ejector lever 26, when a package is detected by an infeed proximity switch. When the ejector servo motor 31 returns to the "home" position, the straw cutter servo motor 61, which also drives the straw drum 21, receives a signal to begin turning. There are 24 cutting blades 42 around the blade drum 25 which results in 15 degree spacing and degree travel increments by the straw cutter servo motor 61. The ejector bars 26 remove the cut straws 11 from the plurality of grooves 23 around the circumference of the straw drum 21 for attachment to containers 28."

Figure 4:
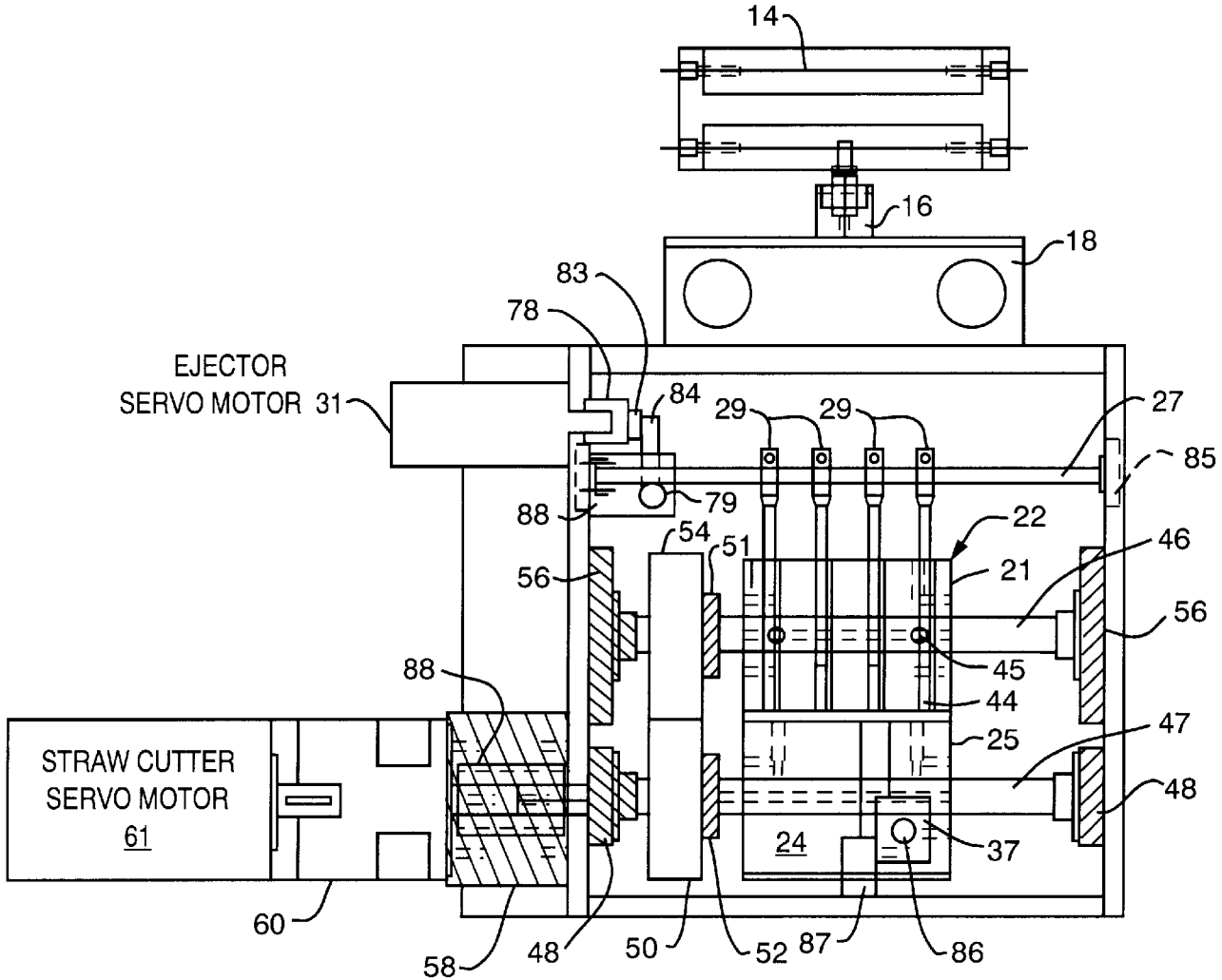
FIG. 4 is a top view of the straw application apparatus of FIG. 1.

Referring now to FIG. 4, a top view of the straw application apparatus 10 shows the arrangement of the primary elements described above for FIG. 1. The slotted roller assembly 22 is shown adjacent to and in the same horizontal plane as the blade cutting roller assembly 24. The straw drum 21 is positioned on a driven shaft 46.

"Four ejector bars 26 extend from the shaft 27 of the ejector servo motor 31, and they are positioned in four equally spaced grooves 44 around the circumference of the straw drum 21 for removing the straws 11 from the straw drum 21 after being separated from the web 12. The blade drum 25 is disposed on a shaft 47 extending between a bearing 56 at both ends and a spur gear 50 at one end. The spur gear 50 is connected using a key (not shown) and a taper lock bushing 52 to secure in place to the drive shaft 47. The drive shaft 47 is connected to a gear box 60 by means of a rigid coupling and key which is driven by a straw cutter servo motor 61. The straw cutter servo motor 61 is controlled by a preprogrammed programmable logic controller (not shown) which is obtained from Allen Bradley of Milwaukee, Wis. for indexing the straw drum 21 in fifteen (15) degree increments to cut the straw for eventual application to a package. The gear box 60 is mounted to the frame by a spacer block 58. FIG. 4 also shows the positioning of pivoting straw assembly 14 which attaches to the pivot bearing assembly 16, and the fixed straw guide assembly 18 is positioned on top of the support column 17."

The blade drum 25 and the straw drum 21 are geared to each other by two spur gears 50, 54 that match the drum diameters. The gears are held in place by the taper lock bushing 52. As the drums 21, 25 turn inward, straws 11 are pulled from the supply and become cut by serrated blades 42 that push through the packaging material of the straw web 12 at a point centered between the straws 11. Slots 19 on the straw drum 21 allow the blades 42 to pass through the material and into the straw drum 21. Grooves 23 on the straw drum 21 are narrower than the outside diameter of the straws. They hold the straws 11 onto the straw drum 21 until the straws 11 are ejected onto the packages 28 by a set of ejectors 26. The typical speed of applying the straws 11 to packages 28 is in the range of 500–600 per minute for the preferred embodiment.

Figure 5:
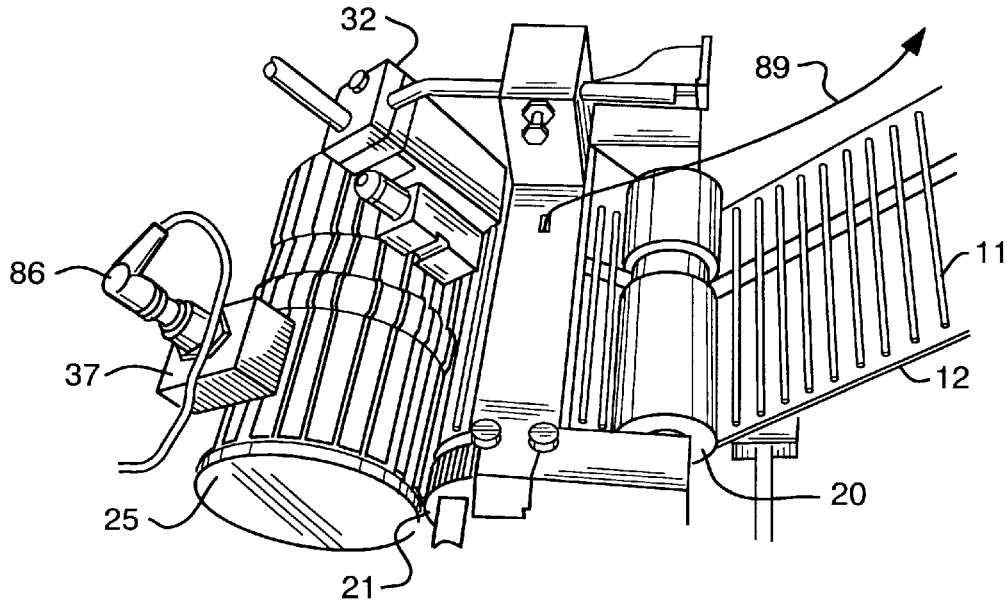
FIG. 5 is a perspective view of the invention showing a guide roller jamming parallel straws into a slotted drum and a blade drum separating the straws as it rotates in close association with the straw drum.

"Referring now to FIG. 5, a perspective view of the invention shows the guide roller 20 pressing a web of parallel straws 11 into straw slots or grooves 23 around the circumference of the straw drum 21. The blade drum 25 comprises the plurality of cutting blades 42 extending above their mounting slots around the circumference of the drum 25. As the straw drum 21 rotates in a counter-clockwise direction, the blade drum 25 rotates in the clockwise direction in close association with the straw drum whereby the blades 42 of the blade drum 25 extend into the slots 19 adjacent to each straw 11 cutting the web material on each side of the straw 11 so that the ejector bars 26 can remove the cut straws 11 from the blade drum 21.

Figure 6:
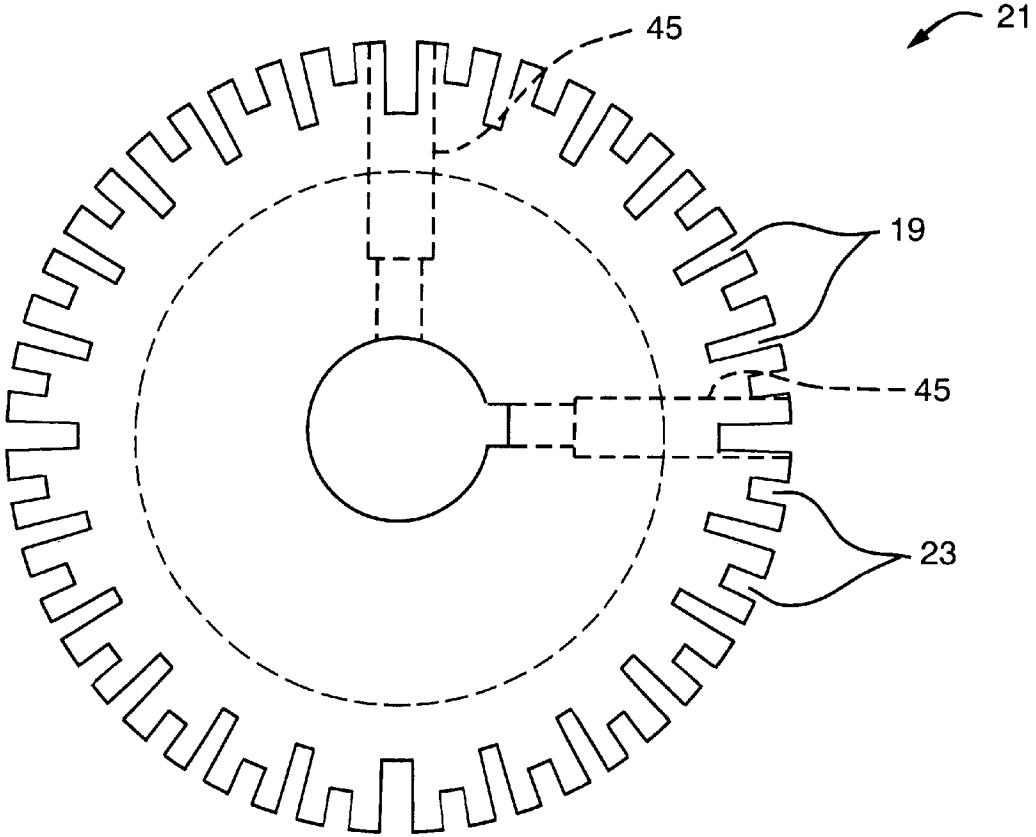
FIG. 6 is a side elevational view of a straw drum.

Referring to FIG. 6, a side elevational view of the straw drum 21 is shown having a plurality of alternately spaced straw slots or grooves 23 and slots 19 around the periphery of the straw drum 21. Each groove 23 holds a straw 11 and the slots 19 permit the cutting blades 42 to penetrate the straw web 12 material and extend into the slots 19, thereby separating the straw 11 from attachment to the web 12. Counterbores with tapped holes 45 are provided for receiving set screws to secure the straw drum 21 to the shaft 46."

Figure 7:
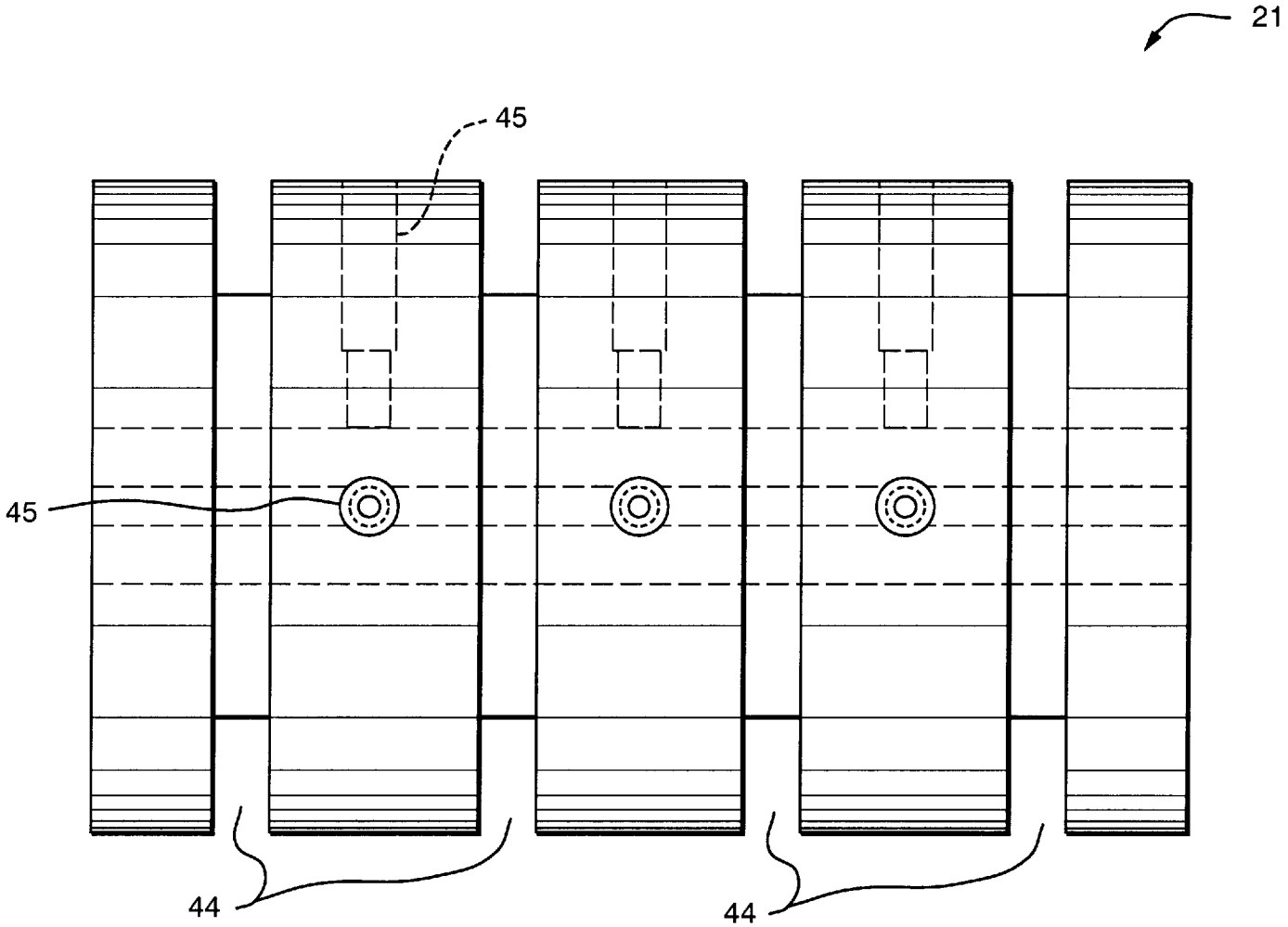
FIG. 7 is a front elevational view of the straw drum.

Referring to FIG. 7, a front elevational view of the straw drum 21 shows the four notches 44 in which the ejector bars 26 rest prior to removing straws from the straw drum 21.

Figure 8:
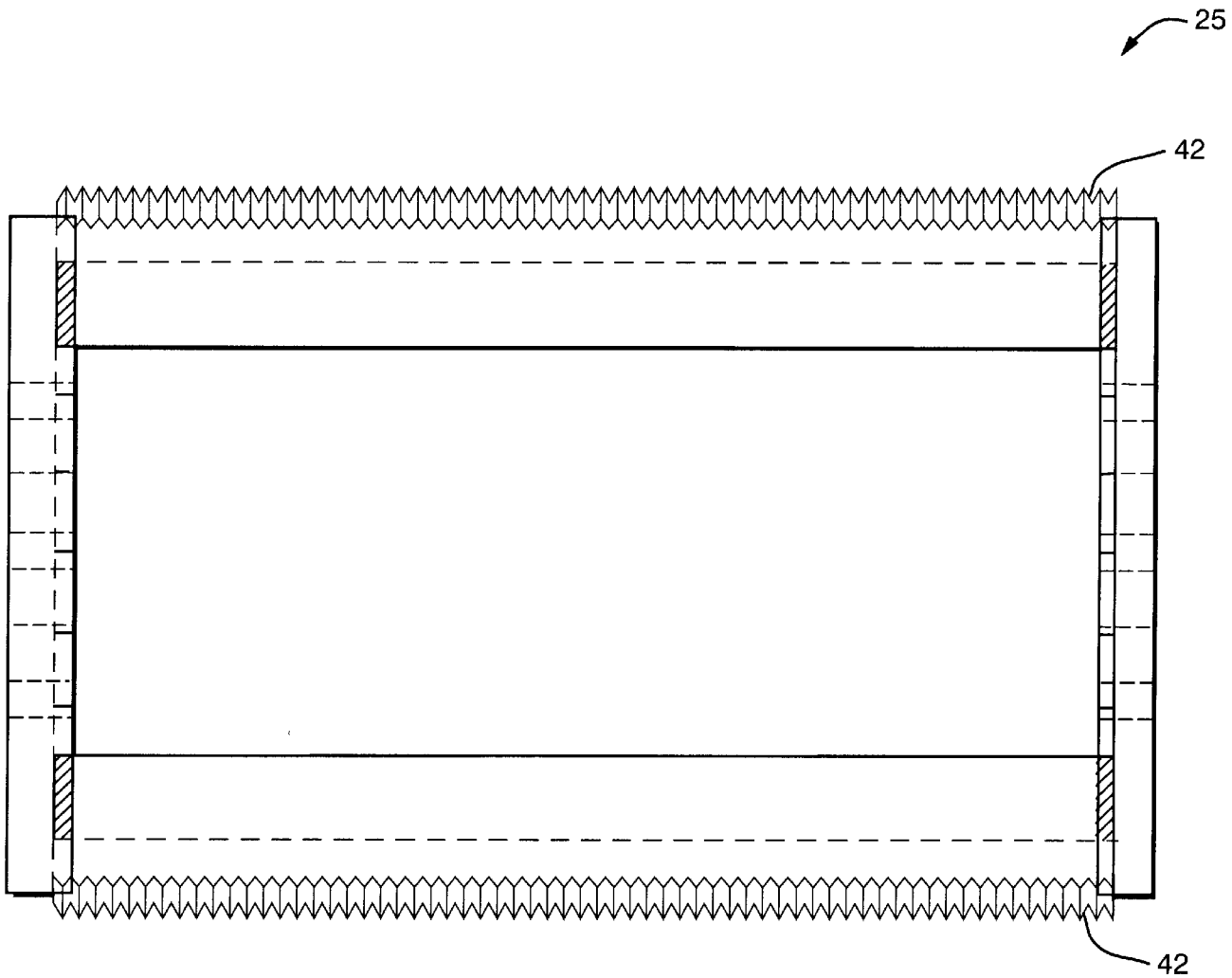
FIG. 8 is a front elevational view of a blade drum.

Referring to FIG. 8, a front elevational view of the blade cutting drum 25 is shown comprising a plurality of cutting blades 42 mounted around the circumference of the blade drum 25. Two blades are shown at the top and bottom of the blade drum 25. Each blade measures approximately 1.070 inches high, 7 inches long and 0.880 inches deep in the preferred embodiment.

Figure 9:
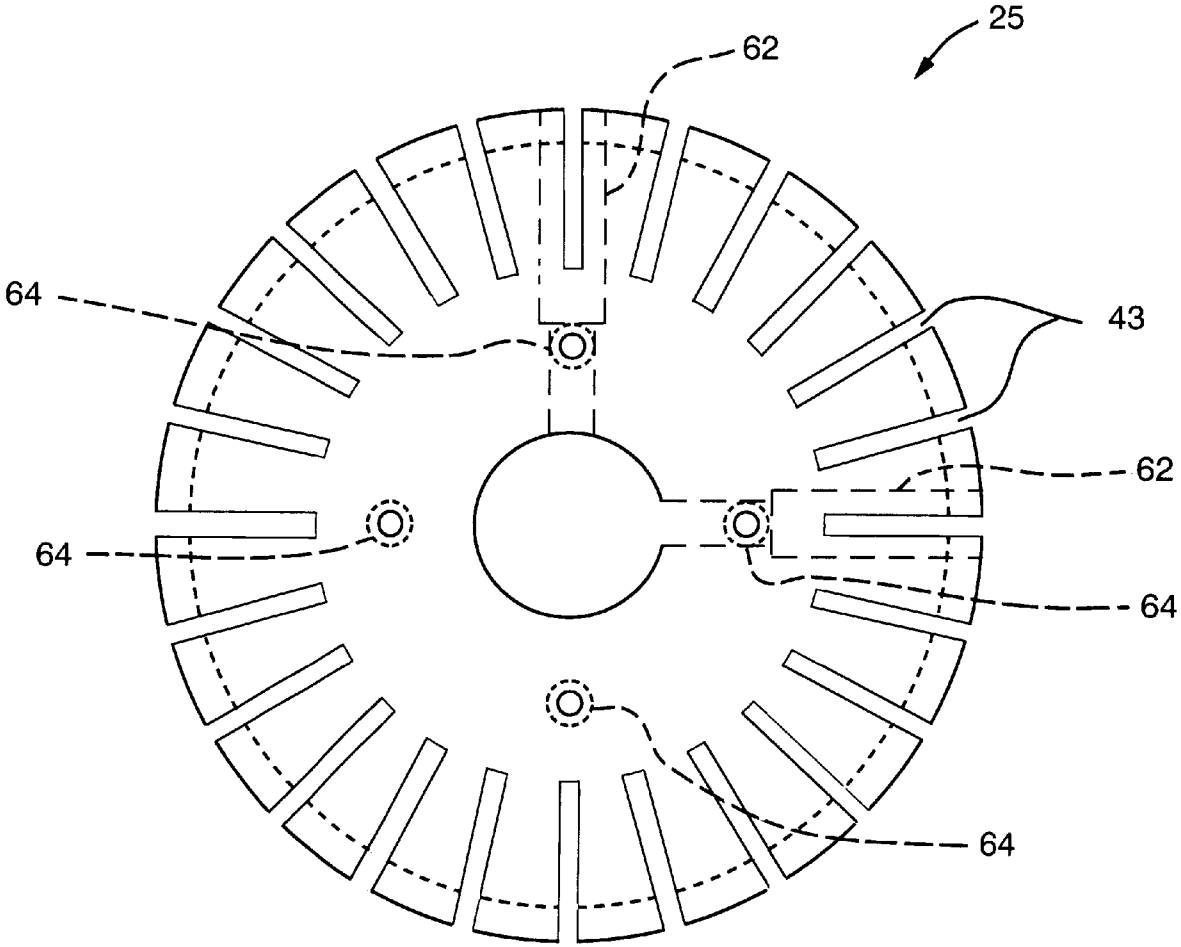
FIG. 9 is a side elevational view of the blade drum for the blade cutting roller assembly showing the slots for insertion of blades.

"Referring to FIG. 9, the side elevational view of the blade drum 25 shows the slots 43 into which the cutting blades 42 are fixed. The diameter of the blade drum in the preferred embodiment is approximately 4.5 inches and the depth of the rectangular slots 43 is approximately 0.880 inches. Counterbore tapped holes 62 are provided for receiving set screws to secure the blade drum 25 to the shaft 47. Tapped holes 64 are provided to receive screws for securing end caps to the blade drum 25 to hold blades 42 onto the drum 25."

Figure 10:
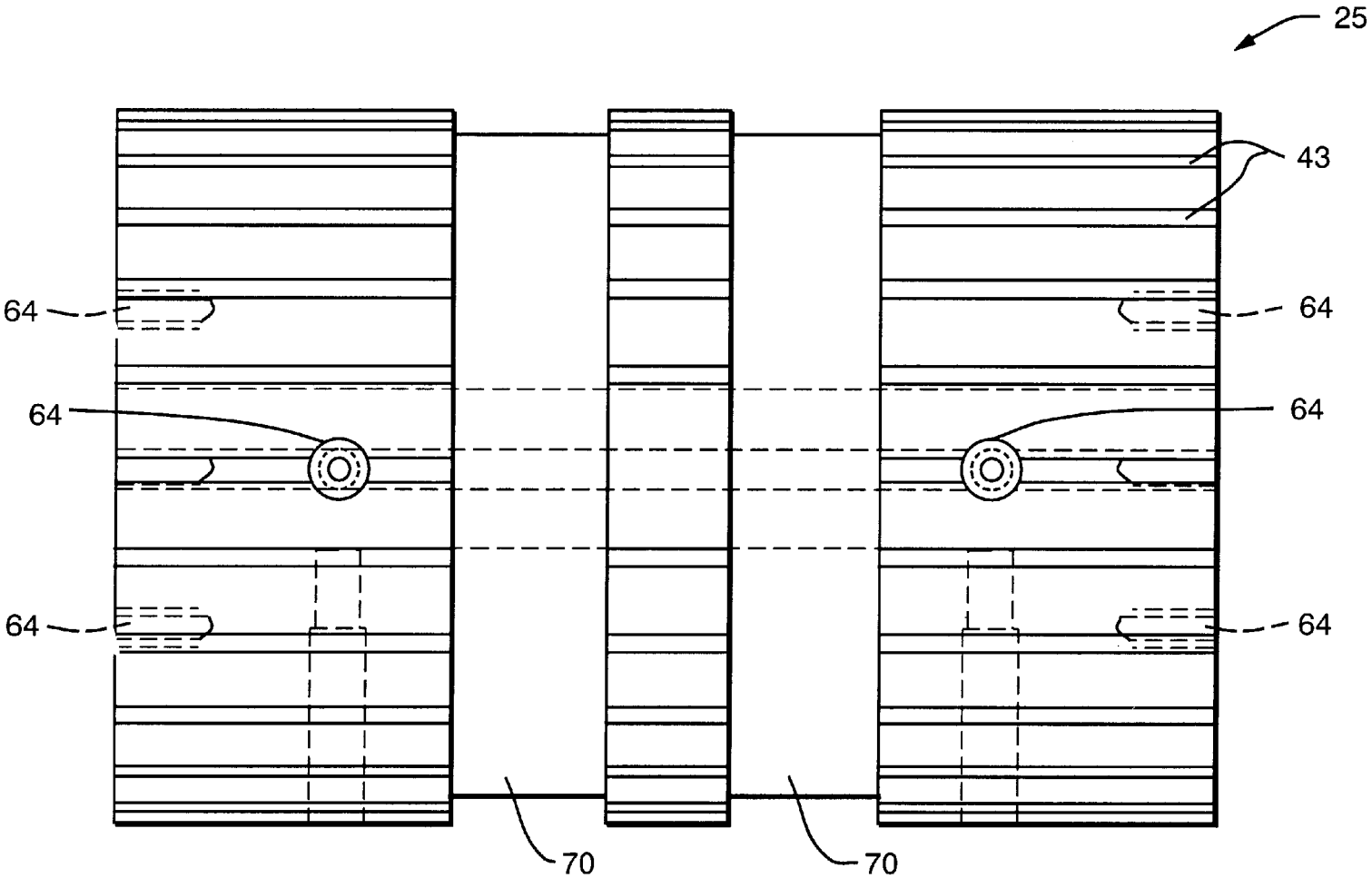
FIG. 10 is a front elevational view of the blade drum.

Referring now to FIG. 10, a front elevational view is shown of the blade drum 25. It is approximately 4.5 inches in diameter and 6.0 inches wide. The counterbore tapped holes 64 are shown at each end of the blades drum 25. The cylindrical spaces 70 provide slots so that the adhesive tape or glue does not stick to the drum 25.

Figure 11:
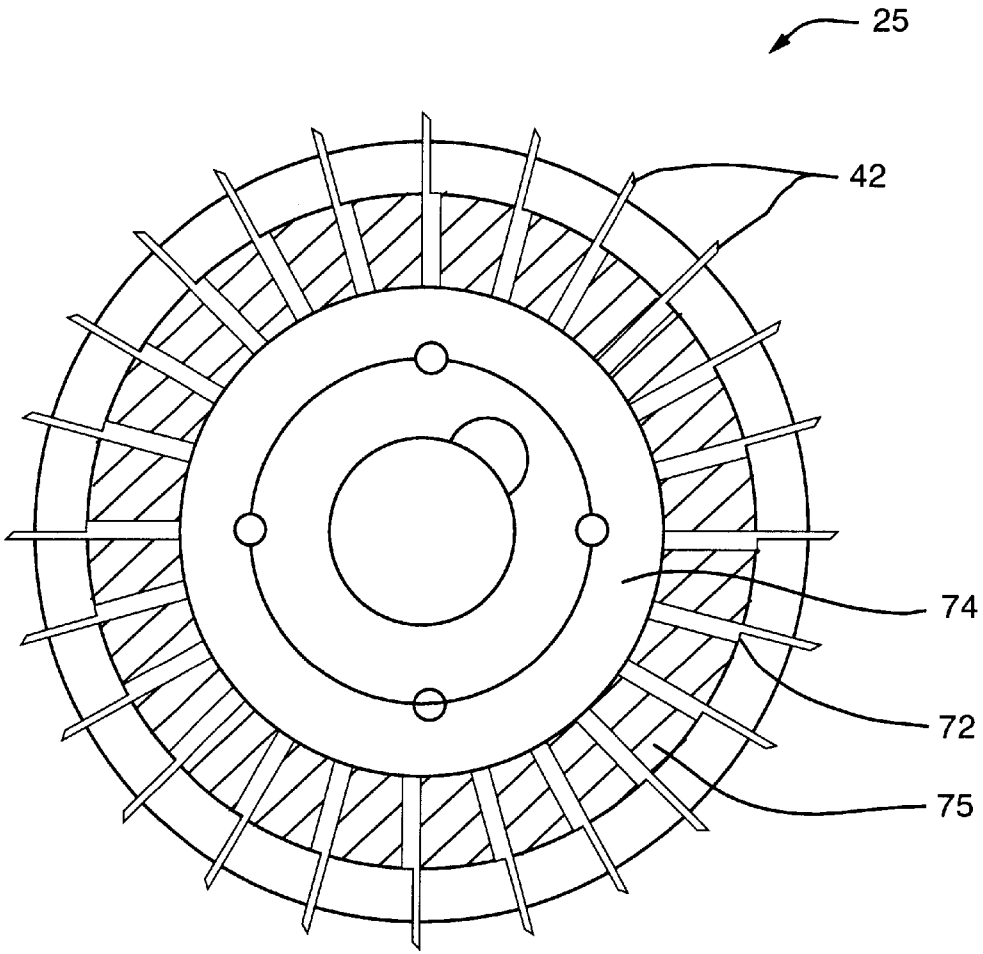
FIG. 11 is a side elevational view of the blade drum showing a block securing end cap.

Referring to FIG. 11., a side elevational view of the blade drum 25 is shown with the blades 42 inserted in the rectangular slots 43. The block securing end cap 74 comprises slots to allow the top portion of the blades 42 to slide into the slots of the caps 74. The blades 42 are held in place by means of a step 72 machined on the blade 42 to hold the blade inside of a groove 75 machined in a circular fashion on the end caps.

Figure 12B:
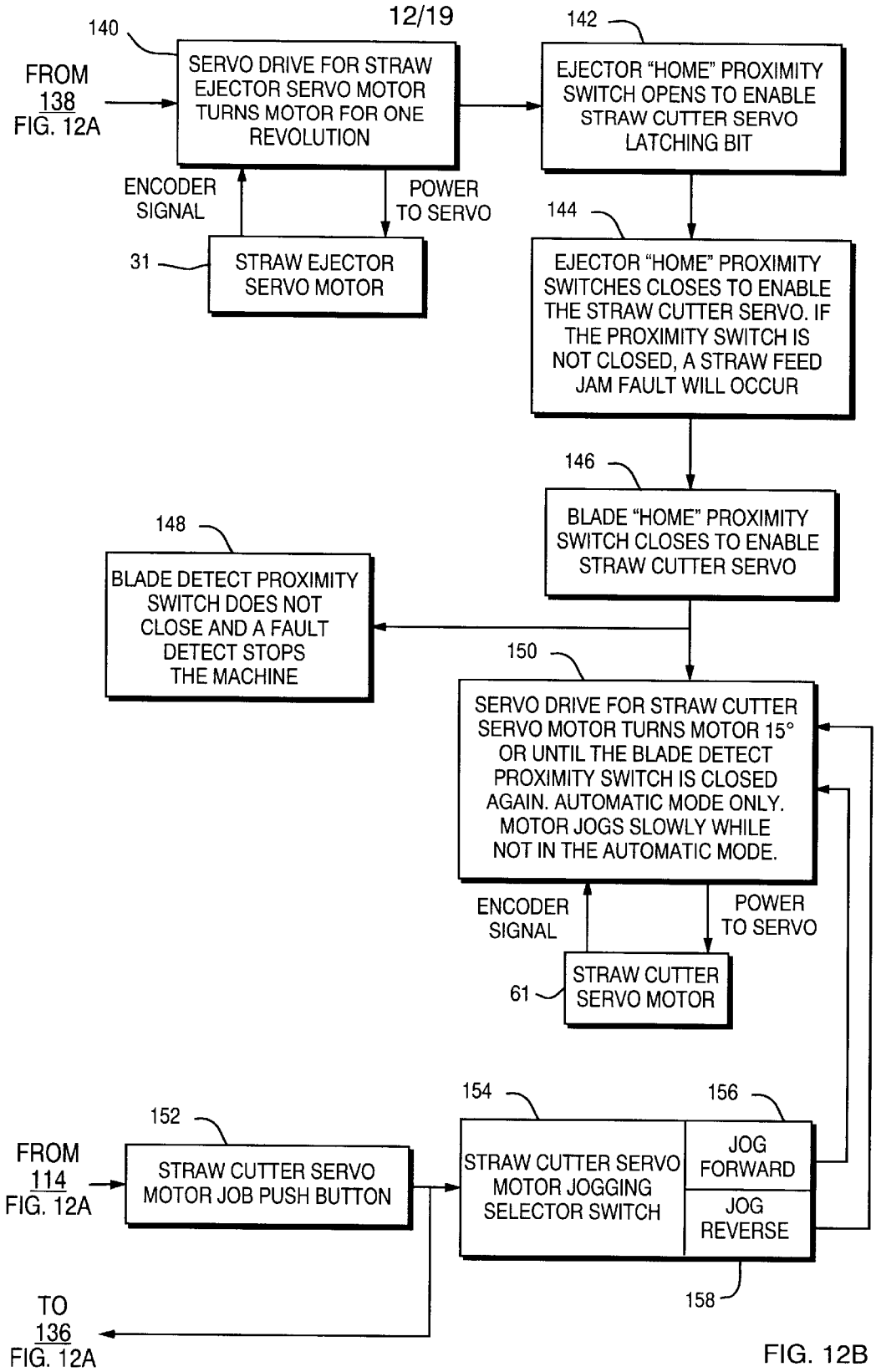

"Referring to FIGS. 12A and 12B, an electrical flow chart is shown for the sensors and control functions required to permit proper operation of the straw applicator apparatus 10. Power 110 is delivered to the apparatus 10. If the guard circuit 112 is closed, the apparatus 10 is ready to be placed into an automatic mode if none of the fault conditions 118 to 126 are present. Once the apparatus is in the automatic mode, pressing the stop automatic pushbutton 116 will stop the apparatus 10 from cycling. Also, while the apparatus 10 is in automatic, if the apparatus 10 should run out of product, the straw detect photo sensor 118 will sense this condition and remove the apparatus 10 from the automatic mode. At this point, the straw detect light 119 will illuminate. If the paper 13 that is removed from the adhesive should break while the apparatus 10 is in the automatic mode, a paper detect photo sensor 120 will detect the break and remove the machine from the automatic mode. A paper detect light 121 will illuminate. When a straw 11 is stuck on the top of the ejector fingers 29, the ejector home proximity switch 79 will not become closed. The apparatus 10 will be removed from the automatic mode and a straw feed jam 122 is detected and a light will illuminate. If the blade detect sensor does not detect a blade or if the sensor is bad, a blade detect light 95 will illuminate and the apparatus 10 will be removed from the automatic mode. If the guard door is opened while in the automatic mode, the apparatus 10 will be removed from the automatic mode and a guard open light 127 will illuminate. After clearing any fault, pressing the fault reset pushbutton 116 will enable the apparatus 10 for automatic cycling."

Whenever the apparatus 10 is not in the automatic mode, the servo motor 61 for the straw drum 21 can be cycled manually. If the jog selector switch 154 is set to forward 156, pressing the jog pushbutton 152 will slowly rotate the straw drum 21 in the clockwise direction. If the jog selector switch 154 is set to reverse 158, pressing the jog pushbutton 152 will slowly rotate the straw drum 21 in the counter-clockwise direction. Pressing the jog pushbutton 152 will energize the scrap vacuum solenoid 136 so that the paper covering the adhesive tape will be drawn away to the trash. When the button is released, the vacuum solenoid will de-energize. Also, whenever the apparatus 10 is not set to the automatic mode, pressing the reset pushbutton will also energize the scrap vacuum solenoid 136. The solenoid will stay on for 30 seconds or until the apparatus 10 is set to the automatic mode.

"After the apparatus 10 is set to the automatic mode, pressing the reset pushbutton will activate the straw ejector servo motor 31 if the ejector home proximity switch 79 is closed. At the same time the straw ejector servo motor 31 is turning, the scrap vacuum solenoid 136 will energize for a pre-set time then shut off.

As product travels down a conveying system, a photo sensor activates the straw ejector servo motor 31 as long as the ejector home proximity switch 81 has been closed.

If the ejector home proximity switch 79 is closed and the straw ejector servo motor 31 is activated, the ejector home proximity switch 81 will open to latch a bit in the Programmed Logic Controller (PLC) for the servo motor 31. When the ejector home proximity switch 79 is closed again a signal is sent to the straw cutter servo motor 61, if the blade home proximity switch 146 is closed, If the blade home proximity switch 146 is not closed, the apparatus 10 will fault and the apparatus 10 will be removed from the automatic mode. When the straw cutter servo motor 61 receives the signal to start, power is sent to the straw cutter servo motor 61 to turn the straw drum 21. A signal is sent back and forth from the straw cutter servo motor 61 to the controller by means of an encoder. The encoder allows the servo motor 61 to turn for a distance of fifteen degrees. If the blade home proximity switch 146 is closed before the fifteen degree distance, the servo motor 61 will stop."

Referring again to FIG. 1 and FIG. 4, the method of setting-up the straw drum 21 to properly receive the blades 42 of the blade drum 25 is critical to the proper operation of apparatus 10.

"First, the blade drum 25 is centered to the exposed portion of the straw feed servo motor drive shaft 47. The blade drum 25 is positioned to the shaft by a ¼" key. The blade drum 25 is then locked to the shaft by means of a taper lock bushing 52 that tightens the bushing to the shaft 47 as bolts are tightened.

Second, the straw drum 21 is mounted onto the driven shaft 46 without a ¼" key inside the straw drum 21. A taper lock bushing 52 is held to the shaft by a ¼" key. Before locking the taper lock bushing 52, the straw drum 21 is rotated by hand until any blade 42 is in a tangential position to any longer and narrower slot 19 of the straw drum 21."

"Third, the bolts (not shown) on the taper lock bushing 52 are turned gently to tighten them onto the shaft so that the straw drum 21 can be rotated on the shaft 46 by hand using a moderate amount of force. The two drums 21, 25 are rotated to check for correct alignment. If the blades 42 do not touch the straw drum 21, the alignment is good. If the blades 42 touch on one side, the straw drum 21 is rotated on the shaft to keep the blades 42 centered in the slots 19 of the straw drum 21. Rotate the drums 21, 25 together 360 degrees to check that all blades 42 on the blade drum 25 fit properly in the slots 19 of the straw drum 21."

Fourth, after checking for proper alignment, a ¼" wide bar of UHMW plastic is inserted into the teeth of the spur gears 50, 54. Then, tightening the bolts (not shown) of the taper lock bushings 51, 52 is started about ¼ of a turn each in a clockwise manner. After the first ¼ turn of tightening, the meshing of the blades 42 to the straw drum 21 is rechecked again. If the blades touch the straw drum 21, the bolts are loosened and the taper lock bushings 51, 52 jacked apart and repeat this procedure. If the mesh of the blades to the straw drum 21 is good, the bolts are tightened sequentially until the bolts no longer can turn.

The key components for implementing the preferred embodiment of apparatus 10 are described as follows: The straw drum 21 may be obtained from Protol Machine of Hudson, N.H. The 10-1 gear box 60 with MP115-027 may be embodied by Model No. PG-115-010 manufactured by Bayside Controls of Port Washington, N.Y. The taper lock bushing 52 may be embodied by Model No. PIXI manufactured by Browning of Maysville, Ky. The straw cutter servo motor 61 may be embodied by Part Number Y-2012-2 HOOAA manufactured by Rockwell/Alliance of Eden Prairie, Minn. The spur gears 50 may be embodied by Model No. N558P36 manufactured by Browning of Maysville, Ky.

Software and related hardware for the straw cutter servo motor 61 and the ejector servo motor 31 may be obtained from Allen Bradley of Milwaukee, Wis. including a 20 peak drive amplifier, Model No. 1398-PDM-020, for the straw cutter servo motor 61, a 15 amp Ultra Indexer Drive, Model No. 1398-DDM-009X and a Micrologic Programmable Logic Controller (PLC) 32, Model 1761-L32BWB.

Figure 14:
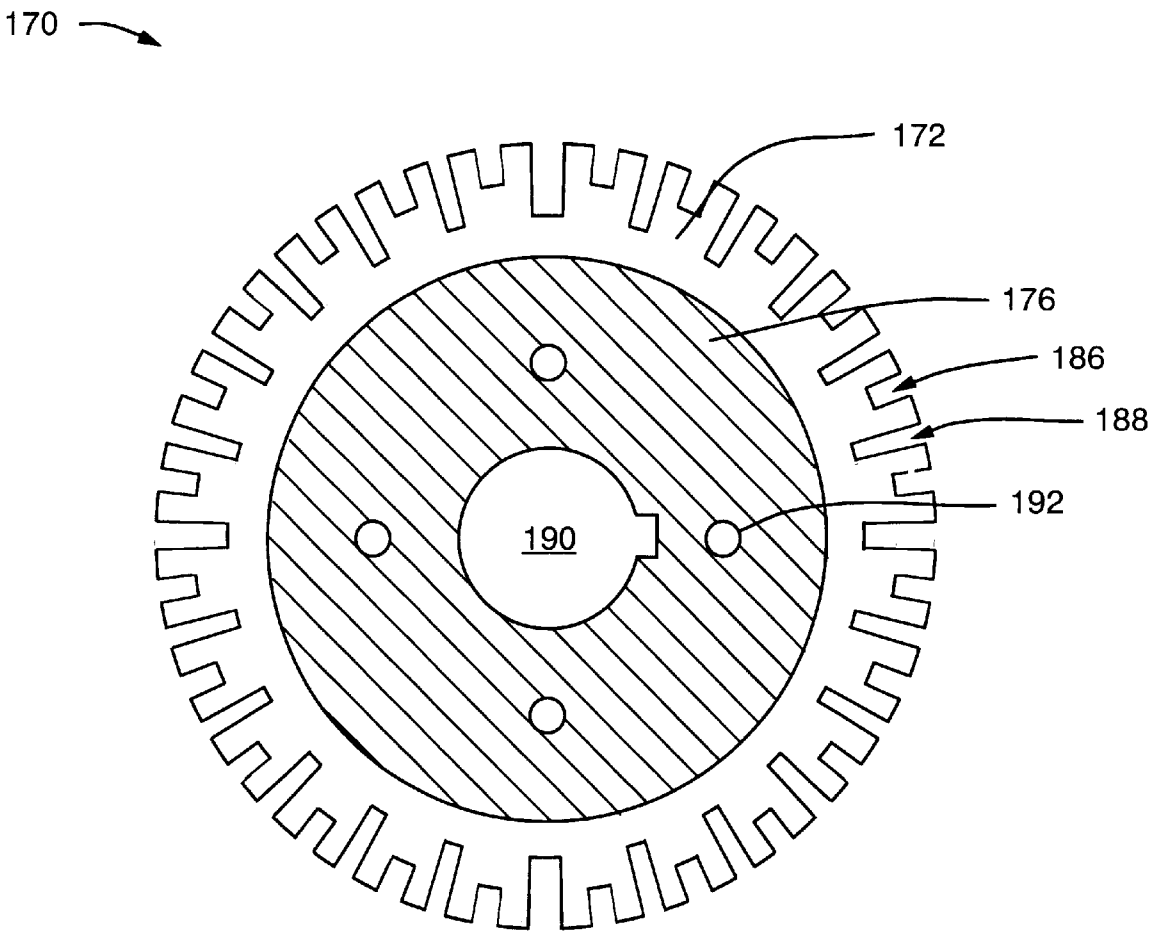
FIG. 14 is a side elevational view of the first alternate embodiment of FIG. 13 showing a rubber end.
Figure 15:
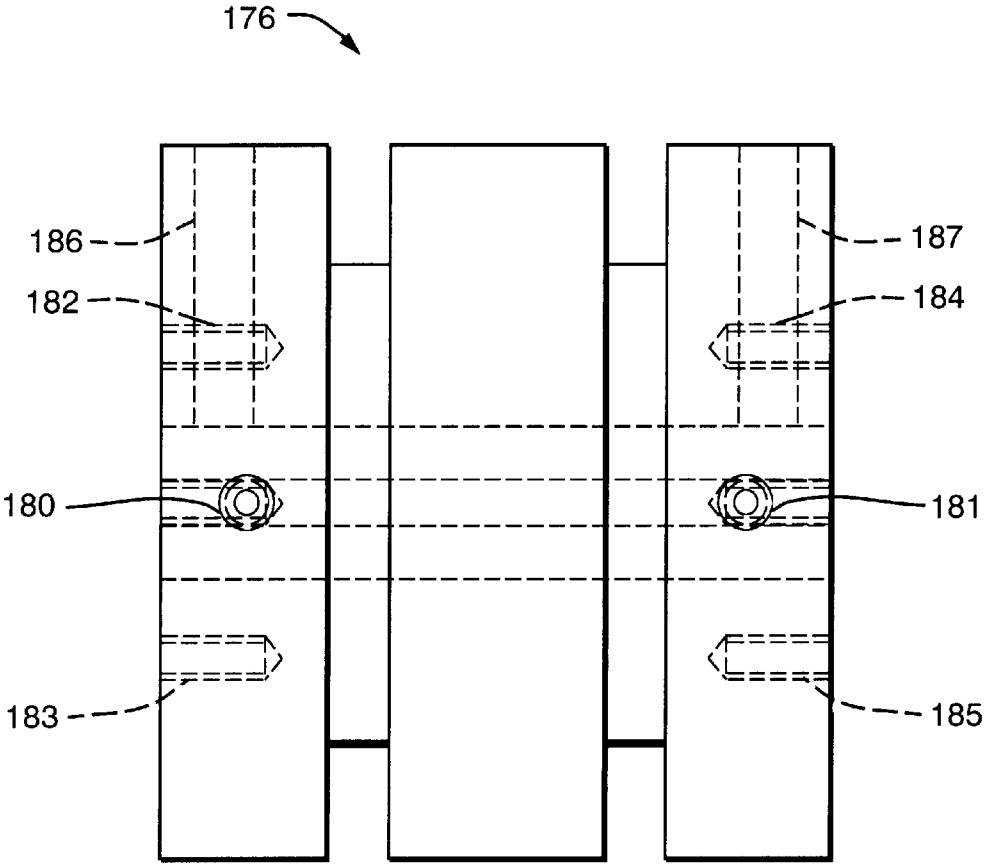
FIG. 15 is a front elevational view of the center portion of the first alternate of the straw drum of FIG. 13.
Figure 16:
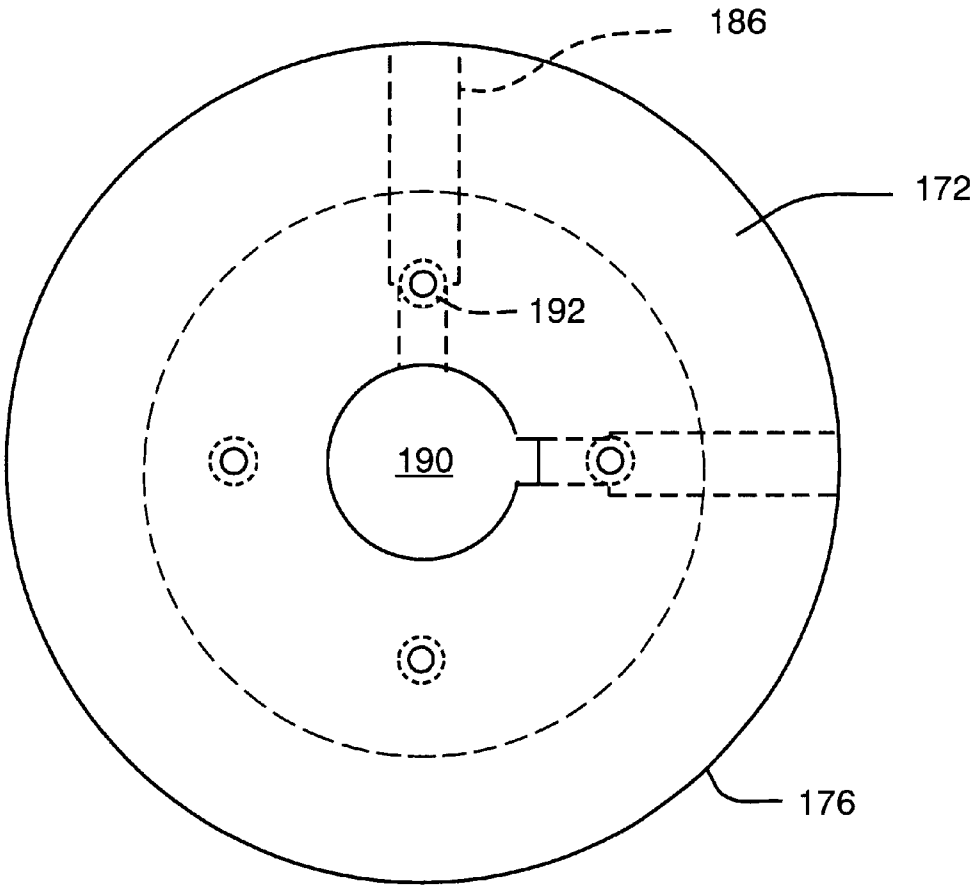
FIG. 16 is a side elevational view of the center portion of the straw drum of FIG. 15.

"Referring to FIGS. 13, 14, 15, 16, FIG. 13 is a front elevational view of a first alternate embodiment of the straw drum 170 comprising molded rubber ends 172, 174. FIG. 14 is a side elevational view of the first alternate embodiment of FIG. 13 showing the rubber end 172, positioned over the end of the straw drum center 176. The rubber ends straw drum 170 provides the ability to hold larger diameter straws, and the straws become more oval as they become larger. FIG. 15 is a front elevational view of the center portion 176 of the straw drum 170 with the rubber ends 172, 174 removed. FIG. 16 is a side elevational view of the straw drum center 176. Hence, the first alternate embodiment of the straw drum 170 is a three piece assembly and comprises rubber ends 172, 174 and drum center 176."

"Referring to FIG. 13 and FIG. 14, counter bore tapped holes 180, 181, 187, 189 are provided in the drum center 176 for receiving set screws to secure the straw drum 170 to the shaft 46. The two circular grooves 178, 179 around the drum 170 are provided for placement of the ends of the ejector bars 26. FIG. 14 shows the side or end view of the first alternate embodiment straw drum 170 with four holes 192 provided to secure the rubber ends 172, 174 to the drum center 176. A plurality of alternately spaced short grooves 186 and slots 188 are provided around the periphery of the first alternate embodiment straw drum 170. Each groove 186 holds a straw and the slots 188 receive the cutting blades 42 to penetrate a straw web material 12 and extend into the slots 188, thereby separating the straws 11 from attachment to the web. In the center of the first alternate embodiment straw drum 170 is the opening 190 for insertion of the shaft 46, and set screws in holes 180, 181, 186 and 187 secure the drum 170 to the shaft 46."

The rubber ends 172, 174 provide for holding larger straws in the grooves 186. As straws become larger in diameter, they become more oval and the rubber grooves 186 are more flexible for holding the oval shaped larger straws. The size of the grooves 186 is determined by the size of the straw being applied to a package.

Figure 18:
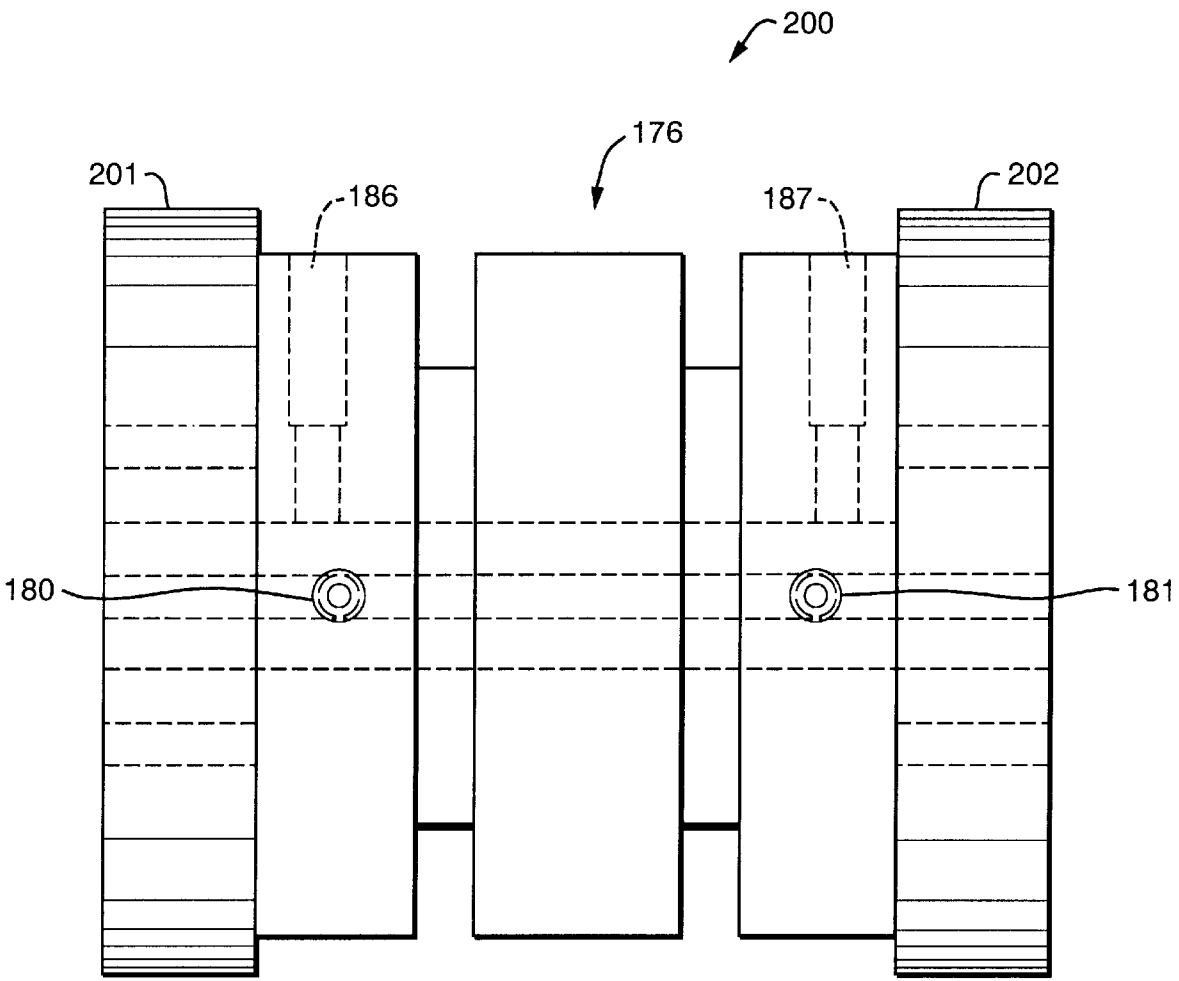
FIG. 18 is a front elevational view of the second alternate embodiment showing the insert end plates attached to each end of the center portion of FIG. 15.
Figure 20:
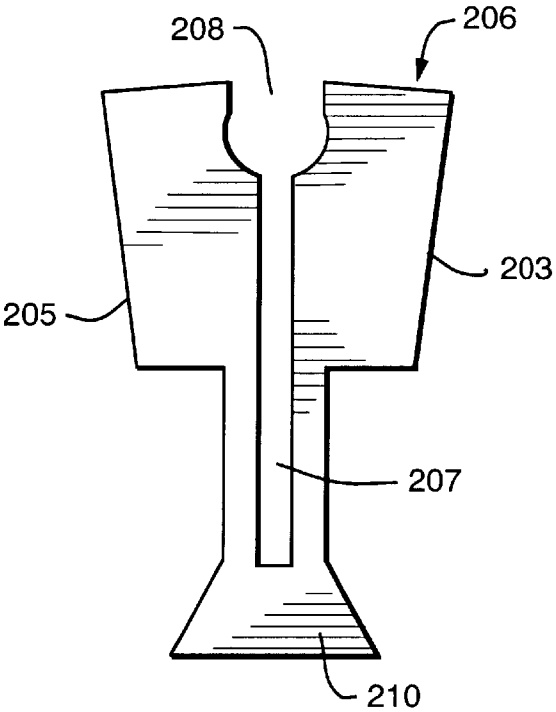
FIG. 20 is a side elevational view of an insert for the insert end plates of FIG. 18.
Figure 19:
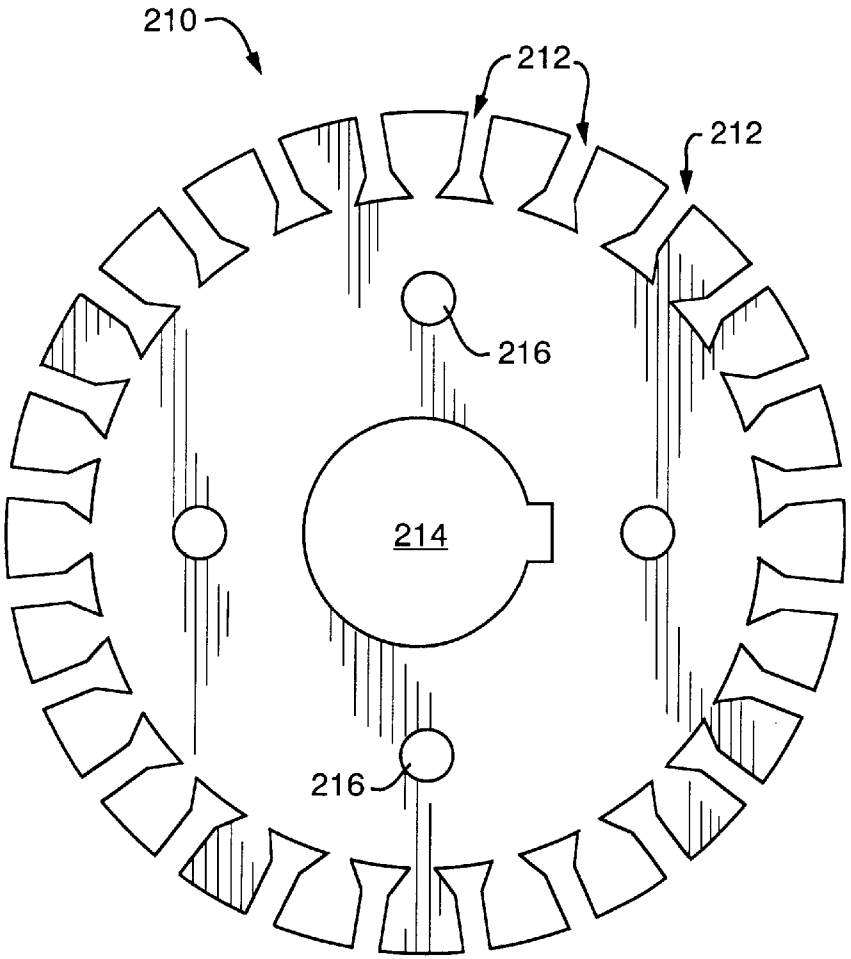
FIG. 19 is a side elevational view of a portion of the insert end plate without the insert.

Referring to FIG. 15, FIG. 17, FIG. 18, FIG. 19, and FIG. 20, FIG. 17 shows a side elevational view of a second alternate embodiment of a straw drum 200 having end plates with inserts 206. FIG. 18 shows a front elevational view of the second alternate embodiment 200 which comprises the straw drum center 176 (shown in FIG. 15) with drum ends 201, 202 attached to each end. FIG. 19 shows a side elevational view of a portion of the straw drum ends 201, 202 having a plurality of slots 212 which receive straw holding inserts 206. There are twenty-four slots 212 around the circumference of each drum end 201, 202 in this embodiment. FIG. 20 shows a side elevational view of the insert 206. The insert 206 may be made of extruded aluminum as well as the drum ends 201, 202.

Each of the twenty-four slots 212 around the circumference of the straw drum center 176 receives an insert 206 forming the end plate 200. As shown in FIG. 17 the insert 206 is made of aluminum and shaped like an expanded tuning fork which allows to fit snugly in the slot 212. A tulip shaped opening 208 near the top of the insert 206 having a further rectangular opening 207 extending down the insert 206 producing two flexible legs 203, 205 attached as the insert base 210 for holding a straw 11. The end plates 201, 202 are secured to the drum center 176 by bolts inserted into holes 216, thereby forming a three piece assembly. Counter bore tapped holes 180, 181, 186, 187 are provided in the drum center 176 for receiving set screws to secure the straw drum 200 to the shaft 46.

This invention has been disclosed in terms of certain embodiments. It will be apparent that many modifications can be made to the disclosed apparatus without departing from the invention. For example, although the straws 11 are held in the straw drum 21 by a press fit, another embodiment may be implemented which comprises vacuum means for retaining the straws on a straw drum which is adapted for handling the vacuum means. Therefore, it is the intent of the appended claims to cover all such variations and modifications as come within the true spirit and scope of this invention.

What is claimed as new and desired to be secured by Letters Patent of the United States is:

1. In an apparatus for separating straws from a web at a high rate of speed and attaching each of said straws to one of a plurality of containers, the improvement comprising:

means, rotating in a first direction and having a plurality of slots, for receiving said web of straws;

means, rotating in a second opposite direction and having a plurality of blades, for cutting each of said straws from said web;

means, disposed adjacent to said straw receiving means, for pressing each of said straws into one of said plurality of said slots, wherein said pressing means rolls along an outer surface of said straw receiving means to facilitate said high rate of speed; and means for controlling said receiving means and said cutting means, said receiving means disposed adjacent to said cutting means wherein each of said plurality of blades serially enters a slot on said receiving means to accomplish said cutting.

2. The apparatus as recited in claim 1 wherein said apparatus comprises a straw guide assembly for guiding said web of straws into said apparatus.

3. The apparatus as recited in claim 1 wherein:

said receiving means comprises a first plurality of slots extending a first predetermined depth into said receiving means, and a second plurality of slots extending a second predetermined depth into said receiving means, said first plurality of slots alternating with said second plurality of slots around the circumference of said receiving means.

4. The apparatus as recited in claim 1 wherein said plurality of blades are equally spaced a predetermined distance from each other around the circumference of said cutting means.

5. The apparatus as recited in claim 4 wherein said plurality of blades extend a predetermined distance above said circumference of said cutting means.

6. The apparatus as recited in claim 1 wherein said pressing means cooperates with a straw guide assembly to provide tension to said web of straws enabling said straws to align with said straw slots of said receiving means.

7. The apparatus as recited in claim 1 wherein said plurality of blades of said cutting means extend into said plurality of slots of said receiving means on each side of straw holding slots as said receiving means and said blades of said cutting means rotate in opposite directions.

8. The apparatus as recited in claim 1 wherein said apparatus comprises a first servo motor coupled to an ejector bar for controlling the speed of applying each of said straws to said plurality of containers.

9. The apparatus as recited in claim 1 wherein said controlling means comprises a second servo motor for controlling the rotation of said receiving means and said cutting means.

10. The apparatus as recited in claim 1 wherein said apparatus comprises means positioned above said receiving means, for removing a protective cover of an adhesive tape on said web of straws.

11. The apparatus as recited in claim 1 wherein said apparatus comprises means positioned adjacent to said receiving means for applying an adhesive to said web of straws.

12. The apparatus as recited in claim 3 wherein said receiving means comprises a drum.

13. The apparatus as recited in claim 12 wherein said drum comprises aluminum.

14. The apparatus as recited in claim 12 wherein said drum comprises an inner aluminum portion and an outer flexible material portion.

15. The apparatus as recited in claim 12 wherein said drum comprises:

a center cylindrical, metallic center portion having at least one groove for receiving an ejecting arm;

a first flexible material, circular end means, positioned on a first end of said center cylindrical metallic portion, for holding a first portion of a straw;

a second flexible material, circular end means, positioned on a second end of said center cylindrical metallic portion, for holding a second portion of said straw; and each of said first and second flexible material, circular end means comprises said first plurality of slots extending a first predetermined depth into said straw drum and said second plurality of slots extending a second predetermined depth into said straw drum.

16. The apparatus as recited in claim 1 wherein said drum comprises:

at least one groove around the central circumference of said drum for receiving an ejecting arm;

a first end portion of said drum comprises a group of said plurality of slots positioned around the circumference of said first end portion;

each of said first group of said plurality of slots around said first end portion of said drum comprises insert means for grasping a straw;

a second end portion of said drum comprises a second group of said plurality of slots positioned around the circumference of said second end portion; and each of said second group of said plurality of slots around said second end portion of said drum comprises insert means for grasping said straw.

17. The apparatus as recited in claim 16 wherein said insert means comprises a spaced apart first leg and second leg extending from a base providing flexible upper ends for grasping said straw.

18. An apparatus for separating straws from a web of straws and attaching each separated straw to a container of a plurality of containers at a high rate of speed comprising:

means for receiving said web of straws, said receiving means rotating in a first direction and having a plurality of straw slots;

means for pressing each straw of said web into one of said plurality of straw slots;

means, disposed adjacent to said receiving means and rotating in an opposite second direction, for separating each straw serially from said web at said high rate of speed;

means, disposed adjacent to said straw receiving means, for pressing each of said straws into one of said plurality of said slots, wherein said pressing means rolls along an outer surface of said straw receiving means to facilitate said high rate of speed;

means coupled to said receiving means and said separating means for controlling the rotation of said receiving means and said separating means; and means extending within a portion of said receiving means for ejecting each of said separated straws to contact one of said plurality of said containers.

19. The apparatus as recited in claim 18 wherein said apparatus comprises a straw guide assembly means for guiding said web of straws into said apparatus.

20. The apparatus as recited in claim 18 wherein:

said web receiving means comprises a cylindrical straw drum having a first plurality of slots extending a first predetermined depth into said straw drum, and a second plurality of slots extending a second predetermined depth into said straw drum, said first plurality of slots alternating with said second plurality slots around the circumference of said straw drum.

21. The apparatus as recited in claim 18 wherein said separating means comprises a cylindrical drum having a plurality of blades spaced a predetermined distance from each other around the circumference of said drum.

22. The apparatus as recited in claim 18 wherein said plurality of blades extend a predetermined distance above the perimeter of said blade cylindrical drum.

23. The apparatus as recited in claim 18 wherein said separating means comprises a plurality of blades extending into said plurality of straw slots of said receiving means on each side of said straw slots as said receiving means and said blades of said separating means rotate in said opposite directions.

24. The apparatus as recited in claim 18 wherein said ejecting means comprises a first servo motor coupled to an ejector bar for controlling the speed of applying each of said straws to said container.

25. The apparatus as recited in claim 18 wherein said controlling means comprises a second servo motor for controlling the rotation of said receiving means and said separating means.

26. The apparatus as recited in claim 18 wherein said apparatus comprises means positioned above said pressing means, for removing a protective cover of an adhesive tape on said web of straws.

27. The apparatus as recited in claim 18 wherein said apparatus comprises means positioned adjacent to said receiving means for applying an adhesive to said web of straws.

28. The apparatus as recited in claim 20 wherein said straw drum comprises aluminum.

29. The apparatus as recited in claim 20 wherein said straw drum comprises an inner aluminum portion and an outer flexible material portion.

30. The apparatus as recited in claim 20 wherein said straw drum comprises:

a cylindrical, metallic center portion having at least one groove around the circumference of said straw drum for receiving said ejecting means;

a first flexible material, circular end means, positioned on a first end of said cylindrical metallic center portion, for holding a first portion of a straw;

a second flexible material, circular end means, positioned on a second end of said cylindrical metallic center portion, for holding a second portion of said straw; and each of said first and second flexible material, circular end means comprises said first plurality of slots extending a first predetermined depth into said straw drum and said second plurality of slots extending a second predetermined depth into said straw drum.

31. The apparatus as recited in claim 20 wherein said straw drum comprises:

at least one groove around the central circumference of said straw drum for receiving said ejecting means;

a first end portion of said straw drum comprises a plurality of slots positioned around the circumference of said first end portion;

each of said plurality of slots around said first end portion of said straw drum comprises insert means for grasping a straw;

a second end portion of said straw drum comprises a plurality of slots positioned around the circumference of said second end portion; and each of said plurality of slots around said second end portion of said straw drum comprises insert means for grasping said straw.

32. The apparatus as recited in claim 31 wherein said insert means comprises a spaced apart first leg and second leg extending from a base providing flexible upper ends for grasping said straw.

33. A method for separating straws from a web of straws and attaching each separated straw to a container of a plurality of containers at a high rate of speed comprising the steps of:

receiving said web of straws by means having a plurality of straw slots for holding said straws, said straw holding means rotating in a first direction;

pressing each straw of said web into one of said plurality of straw slots by means disposed adjacent to said holding means wherein said pressing means rolls along an outer surface of said straw holding means to facilitate said high rate of speed;

separating each straw serially from said web at said high rate of speed with means disposed adjacent to said receiving means;

controlling the rotation of said receiving means and said separating means with servo drive means; and ejecting each of said separated straws to contact one of said plurality of containers with means extending within portion of said receiving means.

34. The method as recited in claim 33 wherein said method comprises the step of guiding said web of straws into said receiving means with a straw guide assembly.

35. The method as recited in claim 33 wherein said step of receiving said web of straws comprises the step of providing a straw drum having a first plurality of said straw slots extending a first predetermined depth and a second plurality of slots having a second predetermined depth into said straw drum, said first plurality of slots alternating with said second plurality of slots around the circumference of said straw drum.

36. The method as recited in claim 33 wherein said step of separating each straw serially from said web comprises the step of providing a cylindrical drum having a plurality of blades spaced a predetermined distance from each other around the circumference of said cylindrical drum.

37. The method as recited in claim 36 wherein said step of providing a plurality of blades around the circumference of said cylindrical drum comprises the step of extending said blades a predetermined distance above the surface of said blade cylindrical drum.

38. The method as recited in claim 33 wherein said step of separating each straw serially from said web comprises the steps of:

rotating in a first direction said receiving means comprising a straw drum having said plurality of straw slots with straws of said web pressed therein; and rotating in an opposite second direction said separating means comprising a blade drum having said plurality of blades extending therefrom in close association with said straw drum.

39. The method as recited in claim 38 wherein said step of rotating said straw drum in said first direction and said blade drum in said second direction comprises the step of providing a plurality of blade slots in said straw drum on each side of said straw slots for receiving said plurality of blades extending from said blade drum.

40. The method as recited in claim 33 wherein said step of ejecting each of said separate straws comprises the step of coupling a first servo motor to an ejector bar for controlling the speed of ejecting and applying each of said separated straws to one of said plurality of containers.

41. The method as recited in claim 33 wherein said step of controlling the rotation of said receiving means and said separating means with servo drive means comprises the step of providing pre-programmed second servo motors for controlling the speed of said apparatus.

42. The method as recited in claim 33 wherein said method comprises the step of removing a protective cover of an adhesive tape on said web of straws with means positioned above said receiving means.

43. In an apparatus for separating straws from a web at a high rate of speed and attaching each of said straws to one of a plurality of containers, the improvement comprising:

means, rotating in a first direction and having a plurality of slots, for receiving said web of straws;

means, rotating in a second opposite direction and having a plurality of blades, for cutting each of said straws from said web;

means for controlling said receiving means and said cutting means, said receiving means disposed adjacent to said cutting means wherein each of said plurality of blades serially enters a slot on said receiving means to accomplish said cutting;

said receiving means comprises a drum, said drum having at least one groove around the central circumference of said drum for receiving an ejecting arm;

a first end portion of said drum comprises a group of said plurality of slots positioned around the circumference of said first end portion;

each of said first group of said plurality of slots around said first end portion of said drum comprises insert means for grasping a straw;

a second end portion of said drum comprises a second group of said plurality of slots positioned around the circumference of said second end portion; and each of said second group of said plurality of slots around said second end portion of said drum comprises insert means for grasping said straw.

44. The apparatus as recited in claim 43 wherein said insert means comprises a spaced apart first leg and second leg extending from a base providing flexible upper ends for grasping said straw.

45. An apparatus for separating straws from a web of straws and attaching each separated straw to a container of a plurality of containers at a high rate of speed comprising:

means for receiving said web of straws, said receiving means rotating in a first direction and having a plurality of straw slots;

means for pressing each straw of said web into one of said plurality of straw slots;

means, disposed adjacent to said receiving means and rotating in an opposite second direction, for separating each straw serially from said web at said high rate of speed;

means coupled to said receiving means and said separating means for controlling the rotation of said receiving means and said separating means;

means extending within a portion of said receiving means for ejecting each of said separated straws to contact one of said plurality of said containers;

said web receiving means comprises a cylindrical straw drum having a first plurality of slots extending a first predetermined depth into said straw drum, and a second plurality of slots extending a second predetermined depth into said straw drum, said first plurality of slots alternating with said second plurality slots around the circumference of said straw drum;

said straw drum comprises at least one groove around the central circumference of said straw drum for receiving said ejecting means;

a first end portion of said straw drum comprises a plurality of slots positioned around the circumference of said first end portion;

each of said plurality of slots around said first end portion of said straw drum comprises insert means for grasping a straw;

a second end portion of said straw drum comprises a plurality of slots positioned around the circumference of said second end portion; and each of said plurality of slots around said second end portion of said straw drum comprises insert means for grasping said straw.

46. The apparatus as recited in claim 45 wherein said insert means comprises a spaced apart first leg and second leg extending from a base providing flexible upper ends for grasping said straw.

* * * * *